US007531050B2

(12) United States Patent
Oh et al.

(10) Patent No.: US 7,531,050 B2
(45) Date of Patent: May 12, 2009

(54) METHOD FOR MANUFACTURING BONDED MAGNET AND METHOD FOR MANUFACTURING MAGNETIC DEVICE HAVING BONDED MAGNET

(75) Inventors: Shigun Oh, Sendai (JP); Teruhiko Fujiwara, Sendai (JP); Yasubumi Kikuchi, Sendai (JP); Takashi Yambe, Sendai (JP)

(73) Assignee: Nec Tokin Corporation, Sendai-Shi (JP)

( * ) Notice: Subject to any disclaimer, the term of this patent is extended or adjusted under 35 U.S.C. 154(b) by 511 days.

(21) Appl. No.: 10/528,305

(22) PCT Filed: Sep. 19, 2003

(86) PCT No.: PCT/JP03/11970

§ 371 (c)(1),
(2), (4) Date: Jul. 20, 2005

(87) PCT Pub. No.: WO2004/027795

PCT Pub. Date: Apr. 1, 2004

(65) Prior Publication Data

US 2006/0280921 A1 Dec. 14, 2006

(30) Foreign Application Priority Data

Sep. 19, 2002 (JP) ..... 2002-273362
Jan. 29, 2003 (JP) ..... 2003-019892

(51) Int. Cl.
*H01F 1/08* (2006.01)
*H01F 1/055* (2006.01)

(52) U.S. Cl. ..... 148/103; 148/104

(58) Field of Classification Search ..... None
See application file for complete search history.

(56) References Cited

U.S. PATENT DOCUMENTS 3,985,588 A * 10/1976 Lyman ..... 148/103
4,558,077 A * 12/1985 Gray ..... 252/62.54

FOREIGN PATENT DOCUMENTS

| | | |
|---|---|---|
| JP | 58157118 | 9/1983 |
| JP | 60235416 | 11/1985 |
| JP | 61154118 | 7/1986 |
| JP | 62-167368 | 7/1987 |
| JP | 02-153507 | 6/1990 |
| JP | 2153507 | 6/1990 |
| JP | 4003906 | 1/1992 |
| JP | 5101955 | 4/1993 |
| JP | 5175022 | 7/1993 |

(Continued)

*Primary Examiner*—John P. Sheehan
(74) *Attorney, Agent, or Firm*—Frishauf, Holtz, Goodman & Chick, P.C.

(57) ABSTRACT

A viscous material (4) is obtained by mixing an alloy magnetic powder, magnetized in advance, with a resin. The viscous material (4) thus obtained is applied to an upper surface of a center magnetic leg of an E-shaped core (2). A coil (3) and an I-shaped core are coupled to the E-shaped core (2). An orientation magnetic field is applied by a permanent magnet (5) while the resin is hardened. As a consequence, a bond magnet is obtained which is formed in tight contact with both of a pair of surfaces defining a magnetic gap between the E-shaped core (2) and the I-shaped core.

15 Claims, 21 Drawing Sheets

FOREIGN PATENT DOCUMENTS

| | | |
|---|---|---|
| JP | 5190311 | 7/1993 |
| JP | 06-016976 | 1/1994 |
| JP | 6244047 | 9/1994 |
| JP | 7201544 | 8/1995 |
| JP | 2000-290541 | 10/2000 |
| JP | 2001207201 | 7/2001 |
| JP | 2002105503 | 4/2002 |
| JP | 200315833 | 5/2003 |

* cited by examiner

〈MAGNET FORMATION〉

(a) DISK MAGNET (b) RING MAGNET (c) SELF-ENERGIZATION

DC SUPERPOSED CHARACTERISTIC (GaP)

DC SUPERPOSED CHARACTERISTIC (Hc:4.0kOe)

DC SUPERPOSED CHARACTERISTIC (Hc:5.0kOe)

DC SUPERPOSED CHARACTERISTIC (Hc:10kOe)

DC SUPERPOSED CHARACTERISTIC

DC SUPERPOSED CHARACTERISTIC

Mg SURFACE COATING

Pb SURFACE COATING

Sb SURFACE COATING

Sn SURFACE COATING

METHOD FOR MANUFACTURING BONDED MAGNET AND METHOD FOR MANUFACTURING MAGNETIC DEVICE HAVING BONDED MAGNET

TECHNICAL FIELD

The present invention relates to a bond magnet which is suitable for use in a wide range of devices, such as an actuator, a sensor, or an electronic part, used in various electronic products, small precision instruments, automobiles, and so on and, more particularly, to a method of manufacturing the same and a method of manufacturing a magnetic device using the same.

BACKGROUND ART

A permanent magnet is used in a wide range of fields such as various electronic products, small precision instruments, and automobiles, and is one of important electric and electronic materials. Following a recent request for reduction in size and increase in efficiency of those instruments, a high-performance permanent magnet is desired. In response to such request, a demand for the high-performance permanent magnet is rapidly grown in recent years.

Herein, the permanent magnet is roughly classified into a sintered magnet and a bond magnet. The bond magnet has following advantages that cannot be obtained by the sintered magnet. Recently, the demand for the bond magnet is rapidly increasing in various kinds of actuators, sensors, electronic parts. The advantages are:

(1) A thin complicated shape can easily be obtained.

(2) Cracking hardly occurs as compared with the sintered magnet.

(3) Mass-productivity is excellent.

The bond magnet having the above-mentioned advantages is further classified with respect to a molding method. That is, the molding method is classified into a compression molding method, an injection molding method, and an extrusion molding method. Among others, a manufacturing method using the compression molding method is a method using a ferrite-based, SmCo-based, or NdFeB-based magnetic alloy powder as magnetic alloy powder and including the steps of mixing a thermosetting resin or the like as a binder with the magnetic alloy powder, filling a resultant powder mixture in a mold, and carrying out compression molding. If the compression molding is performed in a magnetic field, a bond magnet having an anisotropy can be manufactured.

In the injection molding method and the extrusion molding method, a material obtained by hot-kneading the magnetic alloy powder and the thermosetting resin is injection-molded or extrusion-molded in a mold. If the molding is performed in a magnetic field, a bond magnet having an anisotropy can be manufactured.

In recent years, following reductions in size of various electronic products and small-sized precision instruments, actuators, sensors, and electronic parts are also required to be reduced in size. Therefore, a magnetic core used in the above-mentioned components is strongly requested to have a higher magnetic permeability in a greater superposed magnetic field. In a magnet incorporated and used in the above-mentioned components, a wide variety of designs in shapes and characteristics are adopted. Even in such a situation that a large reverse magnetic field is applied to the magnet at an operation point unfavorable as a magnet characteristic, for example, in case of a thin shape, a high reliability such as small deterioration in long-term demagnetization is required.

At the same time, the products and the instruments mentioned above are designed as space-saving products and are therefore disadvantageous in view of heat radiation. As a consequence, the magnet is used at a higher working environment temperature. Thus, even in such a situation that, in a high working environment temperature, a large reverse magnetic field is applied to the magnet at an operation point unfavorable as a magnet, a high reliability such as small deterioration in long-term demagnetization is required.

In recent years, a surface-mount-type coil is desired. For a core used in such a coil, an oxidation-resistant rare-earth magnet which is not deteriorated in characteristics under a reflow condition is essential and indispensable.

Against the background of the global environmental problem, hybrid automobiles are rapidly developed. The number of actuators, sensors, and electronic parts used in the automobiles is therefore increased. Accordingly, a wide variety of designs in shapes and characteristics are adopted also for those magnets used in the above-mentioned components. Therefore, a high reliability is required in a severer working environment. At the same time, a reduction in cost is strongly required.

As an electronic part using a permanent magnet, there is known a magnetic device constituting a magnetic circuit, i.e., a device including at least one of a magnetic core, a yoke, another permanent magnet, and a coil. The permanent magnet is inserted into at least one location in the magnetic circuit constituted by the magnetic device and applies a magnetic bias to the magnetic circuit. As a device of this type, an inductance element is described in, for example, Japanese Unexamined Patent Application Publication (JP-A) No. 2002-231540.

For example, a conventional magnetic device is manufactured in the following manner.

At first, as shown in FIG. 32(*a*), a sheet magnet 321 having a predetermined shape and a predetermined size is manufactured by a known method. Alternatively, a bond magnet is manufactured by the compression molding method, the injection molding method, or the extrusion molding method, mentioned above.

Next, as shown in FIG. 32(*b*), the sheet magnet 321 thus obtained is coupled to a pair of cores (E-shaped core 322 and I-shaped core 323) so that the sheet magnet is located in a magnetic gap of a magnetic circuit. At this time, for example, a thermosetting adhesive (not shown) is arranged between each of the cores 322 and 323 and the sheet magnet 321.

Finally, the adhesive is hardened. Thus, a magnetic device as shown in FIG. 32(*c*) is completed.

However, the above-mentioned method of manufacturing a bond magnet using the compression molding is disadvantageous in that, in an anisotropic magnet manufactured by applying a magnetic field during molding, magnetic field orientation of the alloy magnetic powder is poor.

Furthermore, in order to obtain a magnet having a high intrinsic coercive force and hardly demagnetized, a strong magnetic field is necessary during magnetization. However, in the above-mentioned conventional method of manufacturing a bond magnet, the magnetic alloy powder must be magnetized and oriented simultaneously with molding in the mold. For this reason, an excessive magnetic field must be applied to the obtained magnet. Therefore, a large coil is required to generate the magnetic field and a large-scale and complicated molding machine is required.

In addition, with respect to the demand for a wide variety of shapes mentioned above, the conventional molding method is disadvantageous in that a thin bond magnet having a thickness of about 0.5 mm can not be manufactured.

With respect to a magnetization pattern as one of such a wide variety of designs, for example, in radial magnetization in which a magnetic flux is generated in a radial direction in a disk-shaped (or a ring-shaped) magnet from the center of a circle towards an outer periphery, it is difficult to apply a high magnetization field in the above-mentioned radial direction. Even if an iron yoke having a high saturation magnetic flux density is used, the magnetization field has a limit of about 2 T. Therefore, it is impossible to industrially obtain a disk-shaped bond magnet using a magnetic powder having a high intrinsic coercive force.

The above-mentioned Japanese Unexamined Patent Application Publication No. 2002-231540 discloses that a permanent magnet inserted into at least one gap portion of a magnetic path of a magnetic core is magnetized in a magnetic path direction of the magnetic core to thereby obtain an inductance element applied with a magnetic bias. In this method, however, in order to magnetize the permanent magnet inserted into the inductance element, a magnetizer having a magnetization coil larger than the inductance element is necessary. Further, the permanent magnet inserted into the inductance element must be magnetized one by one. Therefore, the method is disadvantageous in facility investment and productivity.

Further, the conventional inductance element disclosed in Japanese Unexamined Patent Application Publication No. 2002-231540 has a problem. that, in the magnetic circuit comprising the ferrite core, the permanent magnet, and the yoke, it is difficult to decrease a gap interval between the permanent magnet and the ferrite core to thereby reduce a magnetic loss. In order to solve this problem, finishing accuracy of machining must be improved. This results in a disadvantage in cost.

As described above, in the method of manufacturing a bond magnet using the conventional method, a large-scale, complicated magnetization coil for orienting and magnetizing the magnetic alloy powder and a large-scale, complicated molding machine are required in order to obtain an alloy magnetic powder having a high intrinsic coercive force. This results in a problem in cost. Further, it is difficult to manufacture a thin bond magnet having a thickness of about 0.5 mm and using the magnetic alloy powder. As another disadvantage, it is difficult to perform magnetization in a complicated pattern such as in the radial direction in the disk-shaped magnet or the like using the magnetic alloy powder.

Therefore, it is a first technical object of this invention to provide a method of manufacturing a bond magnet having a high intrinsic coercive force, which method is capable of forming a desired shape such as a thin shape having a thickness of, for example, 0.5 mm or less without requiring a large-scale, complicated molding machine and a large-scale magnetization coil and which method is capable of performing magnetization in a complicated pattern such as in a radial direction or the like in a disk-shaped magnet or the like.

It is a second technical object of this invention, with respect to a magnetic device which includes at least one of a magnetic core, a yoke, a permanent magnet, and a coil and which has a bond magnet arranged at least one location in a magnetic circuit constituted by the device or outside the magnetic circuit, to provide a bond magnet manufacturing method and a device manufacturing method which are advantageous in facility investment and productivity without requiring a magnetizer having a magnetization coil larger than the device in order to magnetize the bond magnet and without requiring magnetization of the bond magnet arranged in the device one by one.

Therefore, it is an object of this invention to provide a bond magnet manufacturing method which is capable of easily and economically manufacturing a bond magnet having excellent magnetic characteristics, a magnetic device manufacturing method using the bond magnet manufacturing method and to provide an inexpensive bond magnet and an inexpensive device.

DISCLOSURE OF THE INVENTION

According to this invention, there is provided a method of manufacturing a bond magnet, wherein an alloy magnetic powder magnetized in advance is mixed with a resin to obtain a viscous material, and a magnetic field is applied to the viscous material to magnetically orient the alloy magnetic powder included in the viscous material while the resin is hardened.

In the above-mentioned method of manufacturing a bond magnet, the viscous material may be arranged at a predetermined position of a magnetic device in contact therewith, and the magnetic field may be applied to the viscous material arranged in contact with the magnetic device to magnetically orient the alloy magnetic powder included in the viscous material while the resin is hardened.

In the above-mentioned method of manufacturing a bond magnet, before the alloy magnetic powder is mixed with the resin, the alloy magnetic powder may be mixed with at least one metal powder selected from Zn, Al, Bi, Ga, In, Mg, Pb, Sb, and Sn or a metal powder of an alloy thereof to obtain a mixture, and the mixture may be subjected to heat treatment to coat the surface of the alloy magnetic powder with a metal film.

According to this invention, there is also provided a method of manufacturing a magnetic device including a bond magnet, wherein the bond magnet is formed by mixing an alloy magnetic powder and a resin to obtain a viscous material; arranging the viscous material at a predetermined position of the magnetic device in contact therewith; and applying a magnetic field to the viscous material to magnetically orient the alloy magnetic powder included in the viscous material while the resin is hardened, thereby forming the bond magnet at the predetermined position in contact therewith.

In the above-mentioned method of manufacturing a device, if the predetermined position is a pair of surfaces opposite to each other and defining a magnetic gap, the viscous material may be arranged in the magnetic gap to bring the viscous material into contact with both of the surfaces.

Alternatively, if the predetermined position is an end surface of a drum-type core or an outer peripheral surface of a flange portion, the viscous material is applied in a ring shape on the end surface or the outer peripheral surface of the flange portion.

BRIEF DESCRIPTION OF THE DRAWING

FIG. 12(*b*) is a diagram showing another drum-type core of an open magnetic path type, including the bond magnet formed by the method in FIG. 6.

FIG. 12(*c*) is a diagram showing a drum-type core of a closed magnetic path type, including the bond magnet formed by the method in FIG. 6.

FIG. 12(*d*) is a diagram showing still another drum-type core of an open magnetic path type, including the bond magnet formed by the method in FIG. 6.

FIG. 13(*b*) is a diagram for explaining a method of applying an orientation magnetic field to the viscous material applied on the drum-type core using a ring magnet.

FIG. 13(*c*) is a diagram for explaining a method of applying an orientation magnetic field to the viscous material applied on the drum-type core by self-energization of a coil.

BEST MODE FOR CARRYING OUT THE INVENTION

Figure 1:
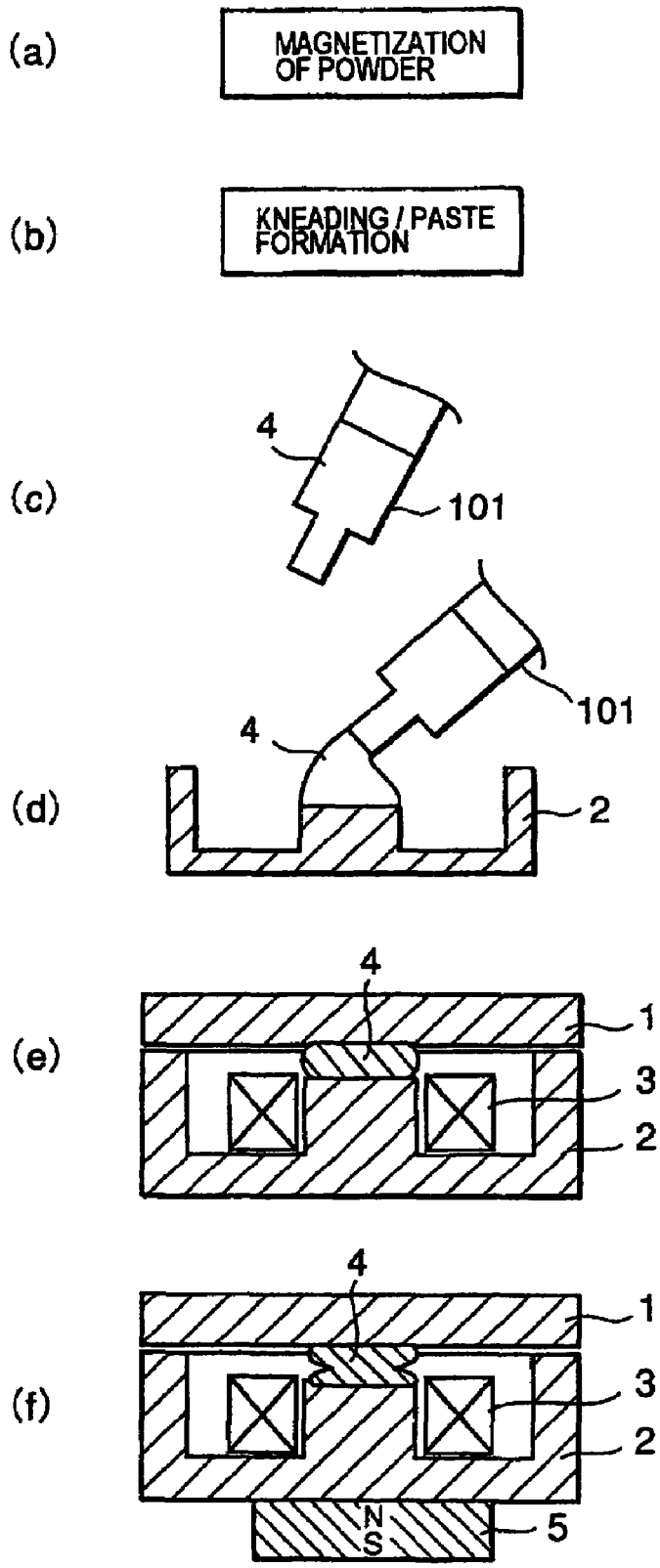
FIGS. 1(*a*) to (*f*) are diagrams for explaining a method of manufacturing a bond magnet according to Example 2 of this invention.

Now, description will be made of a bond magnet according to an embodiment of this invention, a method of manufacturing the bond magnet, a device using the bond magnet, and a method of manufacturing the device.

The bond magnet according to this invention uses, as a magnetic alloy powder (representing an unmagnetized state), a neodymium (Nd)-iron (Fe)-boron (B)-based or a samarium (Sm)-cobalt (Co)-based rare earth magnetic powder or a ferrite-based magnetic powder. At first, the magnetic alloy powder prepared in advance is filled in a non-magnetic cylindrical vessel such as a resin and is placed in a magnetization coil. For example, if the rear earth magnetic powder is used, a magnetic field ranging from 5 T to 10 T is applied to magnetize the magnetic alloy powder.

Next, the magnetized alloy magnetic powder (representing a magnetized state which is discriminated from the above-mentioned magnetic alloy powder) is kneaded with a resin to obtain a paste.

As the resin used herein, a thermosetting resin such as an epoxy resin, a silicone resin, a phenol resin, or a melamine resin is used alone or used after diluted with a solvent. Alternatively, a thermoplastic resin such as a polyamide resin, a polyimide resin, a polyethylene resin, a polyester resin, a polyolefin resin, a polyphenylene sulfide resin, an aromatic nylon, or a liquid-crystal polymer is used alone and hot-kneaded or used after diluted with a solvent.

Preferably, the viscosity of a viscous material prepared by kneading a mixture of the magnetized alloy magnetic powder and the resin is controlled to 10 poises (=1 [Pa·s]) or more. At the viscosity less than 10 poises, the alloy magnetic powder is easily separated from the resin and precipitated. If it is required to uniformly fill or apply the viscous material, careful handling, for example, by stirring is required.

Then, the viscous material is applied onto a desired position of the magnetic device or filled in a mold by using a dispenser (or a cylinder) or the like. In case where a magnetic device is manufactured, a magnetic device assembling step such as the step of coupling a coil to a core is performed. At this time, the viscous material may be used as an adhesive.

Thereafter, the viscous material applied to the desired position of the magnetic device is placed, as it is, in a weak magnetic field ranging from about 30 to about 500 mT to magnetically orient the alloy magnetic powder in the viscous material. At the same time, the resin in the viscous material is heat hardened if it is a thermosetting resin, and is hardened by cooling if it is a thermoplastic resin. Alternatively, if the resin in the viscous material is a resin diluted with a solvent, the resin is hardened while the solvent is dried by heating. When the mold or the like is used, a mold release agent such as silicone grease is desirably applied to the inside of the mold in advance.

Herein, a magnetic field to be applied for orientation (hereinafter referred to as an orientation magnetic field) is a weak magnetic field of 30 to 500 mT and can be applied by a permanent magnet. If desired, however, the magnetic field can be applied by an electromagnet. If the orientation magnetic field is applied by the permanent magnet, the permanent magnet is placed in an environment at a temperature not lower than 120° C. which is a hardening temperature of the thermosetting resin or a softening temperature of the thermoplastic resin. Therefore, the permanent magnet is desirably an SmCo-based magnet or the like having a high Curie temperature Tc.

Further, it is possible to increase a magnetic flux quantity or to reduce a magnetic loss due to a gap by arranging the viscous material prepared in the above-mentioned manner in a magnetic circuit of a magnetic device using a permanent magnet, such as an actuator or a sensor, or by using the viscous material as an adhesive. In this case, it is unnecessary to apply an external orientation magnetic field when the viscous material is hardened. Thus, in this case, the orientation magnetic field is given by the permanent magnet constituting the magnetic circuit so that an anisotropic bond magnet can be formed merely by holding a temperature at which the resin of the viscous material is hardened.

This also applies to the case where the viscous material is arranged at a predetermined position of a magnetic device including at least one of a magnetic core, a yoke, another permanent magnet, and a coil in contact therewith. For example, as a device comprising a magnetic core and at least one coil with a permanent magnet arranged on at least one position in a magnetic circuit, an electronic part such as an inductor of a magnetic bias system is known. In the device of the type, after the viscous material is arranged at a predetermined position of the magnetic core in contact therewith, for example, by applying the viscous material, the coil is energized so that a magnetic flux (i.e., an orientation magnetic field) is generated in the magnetic circuit. Therefore, by merely holding, in the above-mentioned state, the temperature at which the resin of the viscous material is hardened, the resin can be hardened while the alloy magnetic powder in the viscous material is magnetically oriented in a magnetic path direction. As a consequence, a device including an anisotropic bond magnet can be obtained.

Hereinafter, a specific bond magnet, a method of manufacturing the bond magnet, a magnetic device using the bond magnet, and a method of manufacturing the magnetic device will be described as examples of this invention with reference to the drawing.

EXAMPLE 1

An SmCo magnetic alloy powder having an average particle size of 20 μm was magnetized by a pulse magnetic field of 10 T to obtain an SmCo alloy magnetic powder. The SmCo alloy magnetic powder and a two-component epoxy resin were mixed at weight ratios of 70:30, 80:20, 90:10, and 97:3 and kneaded to obtain four kinds of viscous materials.

Each of the four kinds of viscous materials was filled in a nonmagnetic mold of stainless steel having a diameter of 10 mm and a height of 1 mm. The viscous material was heated to 150° C. without pressure while a magnetic field of 0.5 T was kept applied in a direction parallel to a height direction. This state was kept for 2 hours. In this manner, the resin was hardened in the state where the SmCo alloy magnetic powder magnetized in advance was magnetically oriented in the mold. Thus, bond magnets were formed. The bond magnets were taken out from the respective molds as invention products 1 to 4. Herein, silicon grease as a mold releasing agent was applied on the inner surface of the stainless-steel mold.

For comparison, viscous materials were produced in the manner similar to that described above except that the SmCo magnetic alloy powder was not magnetized in advance. Then, a resin was hardened in the manner similar to that described above except that no magnetic field was applied to the viscous material. After taken out from the mold, a pulse magnetic field of 10 T was applied in parallel to the height direction. In the above-mentioned manner, the SmCo magnetic alloy powder in the resin was magnetized. Thus, bond magnets were obtained as conventional examples 1 to 4.

For these magnets, the residual magnetic flux density (Br) was measured by a vibrating sample magnetometer in an orientation (or magnetization) direction and a direction perpendicular to the orientation (or magnetization) direction. The results are shown in Table 1.

TABLE 1

| | | residual magnetic flux density Br | |
|---|---|---|---|
| | | measured value of magnetic field applied during hardening in orientation direction | measured value of magnetic field applied during hardening in perpendicular direction |
| invention product 1 | 70:30 | 0.200 T | 0.010 T |
| invention product 2 | 80:20 | 0.300 T | 0.015 T |
| invention product 3 | 90:10 | 0.500 T | 0.025 T |
| invention product 4 | 97:3 | 0.790 T | 0.040 T |
| conventional product 1 | 70:30 | 0.110 T | 0.100 T |
| conventional product 2 | 80:20 | 0.160 T | 0.150 T |
| conventional product 3 | 90:10 | 0.260 T | 0.240 T |
| conventional product 4 | 97:3 | 0.400 T | 0.390 T |

From Table 1, it has been confirmed that, for the invention products 1 to 4, bond magnets having a high anisotropy were obtained merely by applying a weak magnetic field of 0.5 T during molding. If the weight ratio is less than 70:30, the amount of the alloy magnetic powder is small so that the magnetic flux density is disadvantageously reduced. On the other hand, if the weight ratio exceeds 97:3, the amount of the alloy magnetic powder is excessive so that the magnet disadvantageously becomes mechanically brittle.

Herein, in case of the invention products 1 and 2 in which the weight ratio of the alloy magnetic powder and the epoxy resin is 70:30 and 80:20, the bond magnets can be used as biasing bond magnets for a choke coil. In case of the invention products 3 and 4 in which the weight ratio of the alloy magnetic powder and the epoxy resin is 90:10 and 97:3, the bond magnets can be used as bond magnets for a motor, an actuator, or a sensor which requires a high magnetic flux density.

EXAMPLE 2

Figure 2:
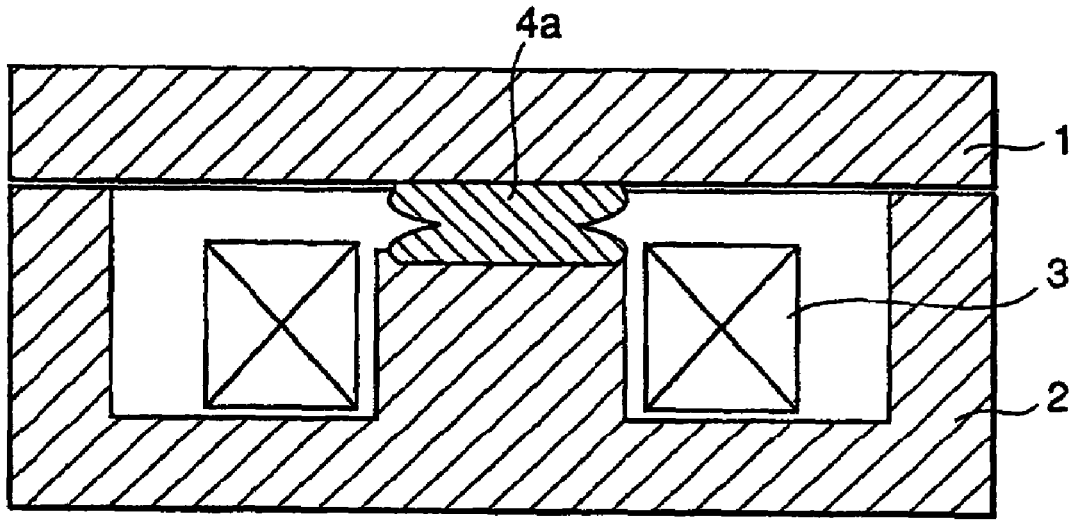
FIG. 2 is a diagram for explaining an inductance device manufactured by the method in FIG. 1.

FIGS. 1(*a*) to 1(*f*) are diagrams for explaining a method of manufacturing a bond magnet (and a magnetic device) according to this invention. Herein, description will be made of a method of manufacturing an inductance device including an Ni—Zn ferrite core comprising an E-shaped core and an I-shaped core as a magnetic device. FIG. 2 is a diagram for explaining the inductance device, manufactured by the method in FIG. 1, as an example of this invention.

At first, in the manner similar to Example 1, an SmCo magnetic alloy powder having an average particle size of 20 μm was magnetized by a pulse magnetic field of 10 T to obtain an SmCo alloy magnetic powder (FIG. 1(*a*)).

Next, the SmCo alloy magnetic powder thus obtained and a two-component epoxy resin were mixed at a weight ratio of a predetermined value between 70:30 to 97:3, for example, 70:30, and kneaded to form a paste, thereby obtaining a viscous material (FIG. 1(*b*)).

Then, as shown in FIG. 1(*c*), the viscous material 4 thus obtained was filled in a dispenser (cylinder) 101.

Then, as shown in FIG. 1(*d*), the viscous material 4 was applied on an upper surface of a center magnetic leg of an E-shaped core 2 by using the dispenser 101. In detail, the viscous material 4 of 10 mg was applied to the E-shaped core 2 having a core outer diameter of 18 mm, a magnetic circuit length of 15 mm, and an effective sectional area of 0.3 $cm^2$.

Then, as shown in FIG. 1(*e*), a coil 3 and an I-shaped core 1 were coupled to the E-shaped core 2. Consequently, the viscous material 4 applied on the upper surface of the center magnetic leg of the E-shaped core was pressed and flattened by the I-shaped core to be deformed, and was brought into contact with both of a pair of surfaces (opposing surfaces) defining a magnetic gap between the E-shaped core 2 and the I-shaped core.

Thereafter, as shown in FIG. 1(*f*), a SmCo-based permanent magnet 5 was arranged under the Ni—Zn ferrite cores 1 and 2. In this state, a resultant structure was placed in an atmosphere of 150° C. for 1 hour to harden the resin contained in the viscous material 4. During this process, a magnetic field was continuously applied to the viscous material 4 by the permanent magnet 5 until the resin is hardened.

Herein, FIG. 2 shows a structure obtained by removing the SmCo-based permanent magnet 5 from the structure in the state shown in FIG. 1(*f*), i.e., an inductance device manufactured by the steps in FIG. 1. The viscous material 4 in FIG. 1 is hardened in FIG. 2 as a bond magnet 4*a*. The bond magnet 4*a* is formed in tight contact with the opposing surfaces defining the magnetic gap between the E-shaped core 2 and the I-shaped core 1, without an adhesive layer required when a conventional sheet-like magnet is used. Under the influence of the viscosity and the surface tension of the viscous material, the shape of a side surface of the bond magnet 4*a* is apparently different from the shape of a sheet-like magnet, a press magnet, or the like manufactured by a conventional punching method or the like. Specifically, the bond magnet 4*a* according to this invention is formed in tight contact with the magnetic core without any gap. The side surface of the bond magnet which does not face the magnetic core has a smooth concavo-convex shape obtained after a free surface of the viscous material is hardened as it is, and is formed by a plurality of curvature surfaces.

Figure 3:
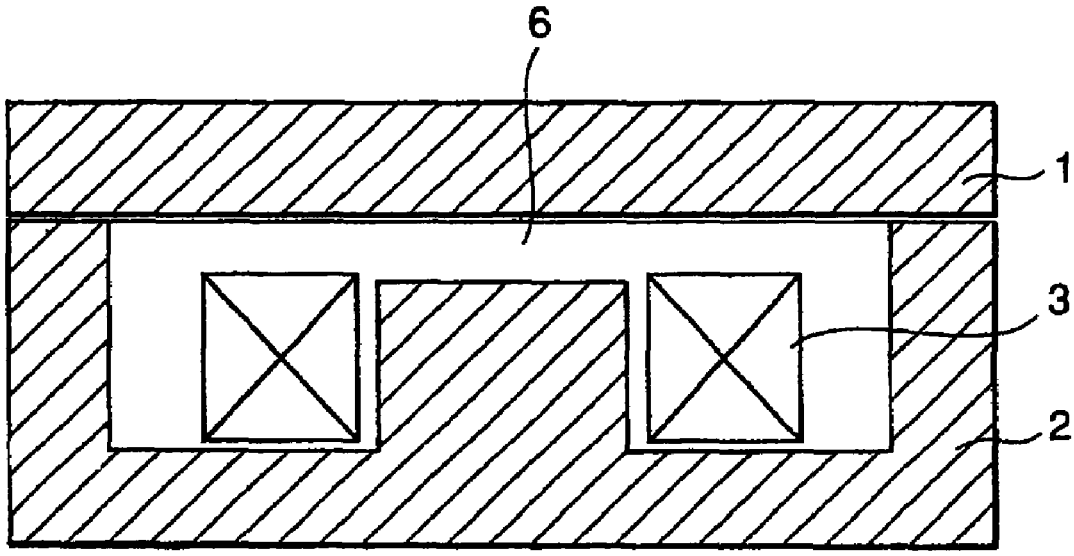
FIG. 3 is a diagram for explaining an inductance device including an E-shaped core and an I-shaped core before a sheet-like magnet is mounted.
Figure 4:
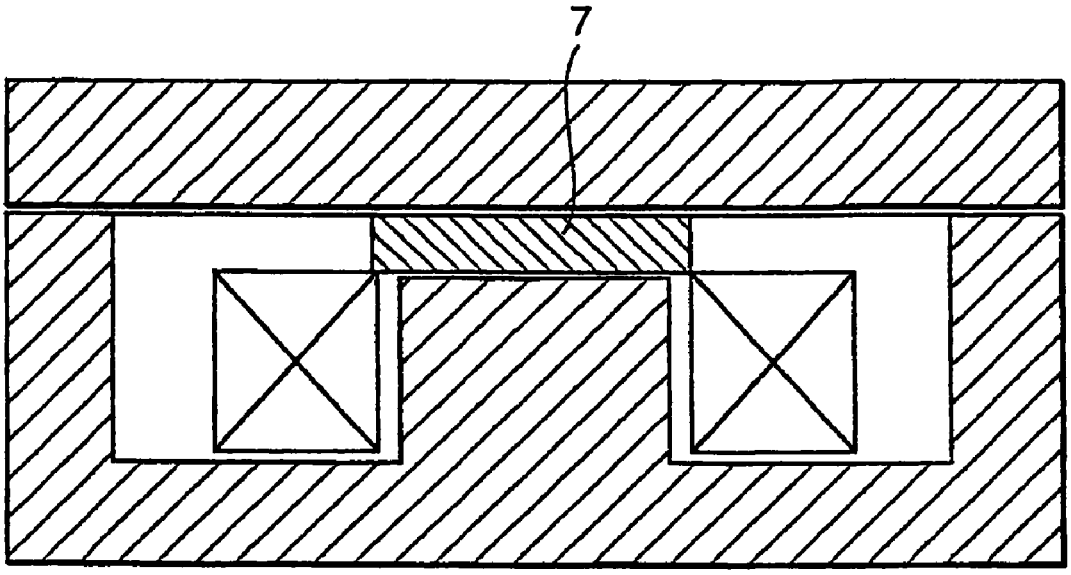
FIG. 4 PRIOR ART
FIG. 4 is a diagram for explaining a conventional inductance device including an E-shaped core and an I-shaped core.

For comparison, a sheet-like magnet prepared by a compression molding method was adhered to a Ni—Zn ferrite core similar to that described above to obtain an inductance device as a conventional example. FIG. 3 is a diagram for explaining the inductance device before the sheet-like magnet is mounted. FIG. 4 is a diagram for explaining the inductance device as the conventional example. As is understood from FIGS. 3 and 4, the conventional inductance device is obtained by inserting the sheet-like magnet 7 into the magnetic gap 6 of the Ni—Zn ferrite core and adhering the sheet-like magnet.

Figure 5:
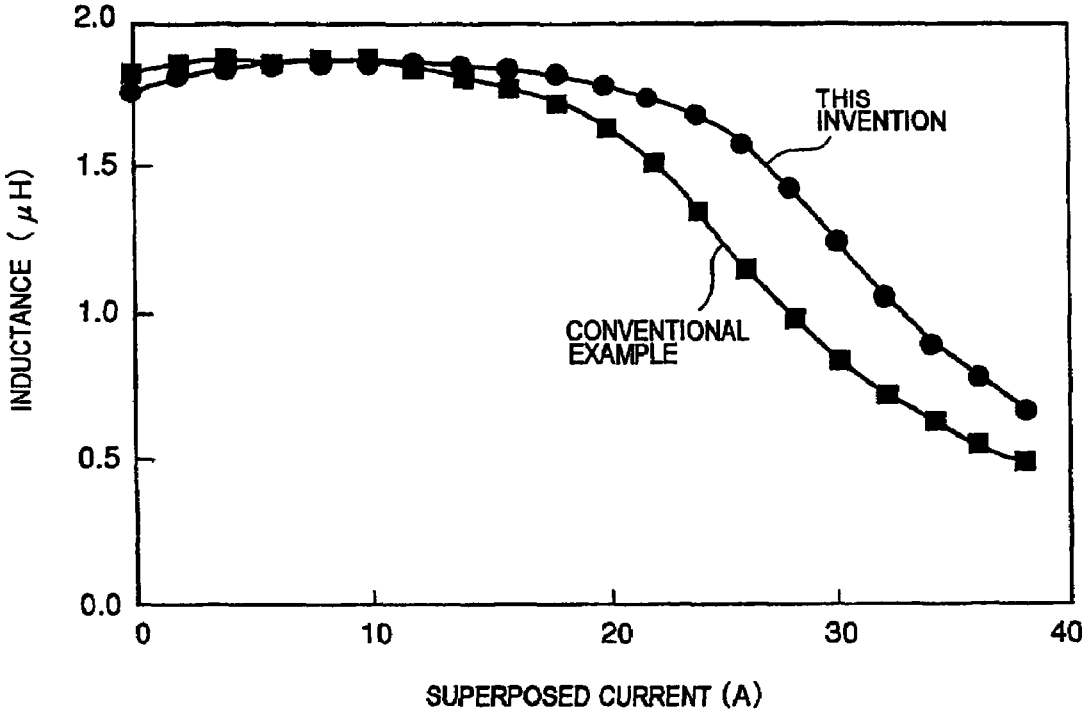
FIG. 5 is a characteristic chart for comparing DC superposition characteristics of the inductor device according to Example 2 of this invention and the conventional inductance device.

FIG. 5 is a characteristic chart for comparison of DC superposition characteristics of the inductance device according to this invention and the conventional inductance device. As shown in FIG. 5, the inductance device according to this invention has a saturation current value higher than that of the conventional inductance device in DC superposition characteristics because the anisotropic bond magnet is formed.

EXAMPLE 3

Figure 6:
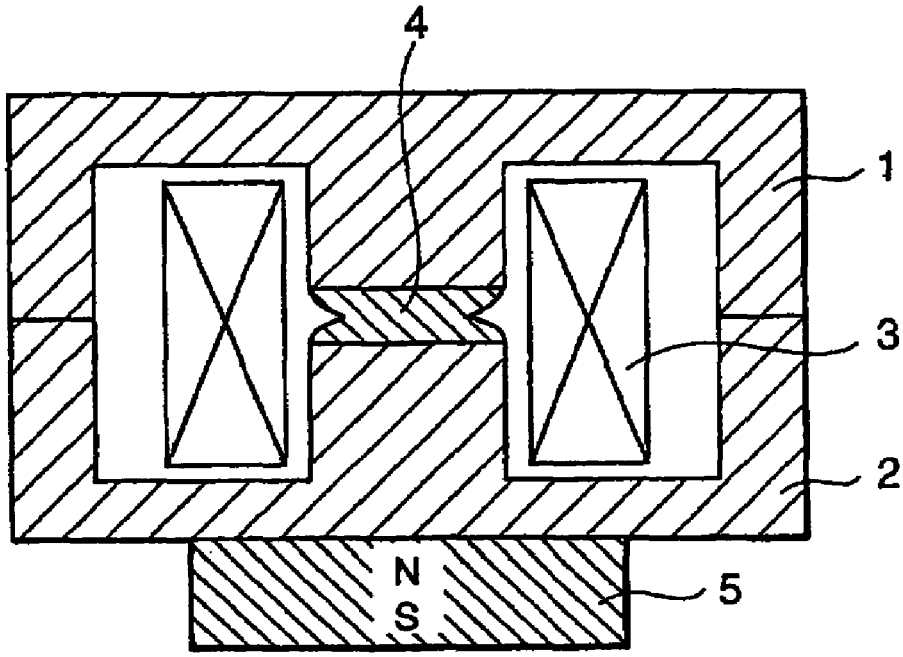
FIG. 6 is a diagram for explaining a method of manufacturing an inductance device (bond magnet) according to Example 3 of this invention.
Figure 7:
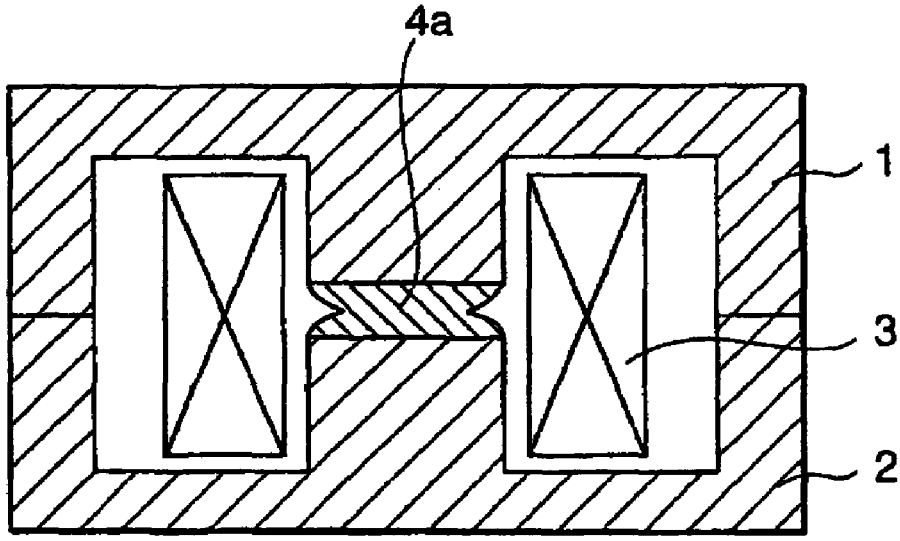
FIG. 7 is a diagram for explaining an inductance device including a pair of E-shaped cores and manufactured by the method in FIG. 6.

FIG. 6 is a diagram for explaining a method of manufacturing a bond magnet (and an inductance device) according to Example 3 of this invention. FIG. 7 is a diagram for explaining the inductance device manufactured by the manufacturing device shown in FIG. 6.

The inductance device according to this example is different from the inductance device of Example 2 in that a pair of E-shaped cores are provided.

As shown in FIG. 6, a viscous material 4 of 8 mg prepared in the manner similar to Example 2 was applied to a gap portion of a center magnetic leg of an Mn—Zn ferrite core comprising an I-shaped core 1 and an E-shaped core 2 and having a core outer diameter of 7 mm, a magnetic circuit length of 13.6 mm, and an effective sectional area of 0.08 $cm^2$. Then, an SmCo-based permanent magnet 5 was arranged under the Mn—Zn ferrite core. In this state, a resultant structure was placed in an atmosphere of 150° C. for 1 hour. As a consequence, the viscous material 4 was hardened. During this process, a magnetic field from the permanent magnet was continuously applied to the viscous material 4.

FIG. 7 shows a state in which the SmCo-based permanent magnet was removed from the structure in the state in FIG. 6, i.e., an inductance device manufactured by the method in FIG. 6. The viscous material 4 in FIG. 1 is hardened into a bond magnet 4*a*. The bond magnet 4*a* is formed in tight contact with opposing surfaces defining a magnetic gap between the E-shaped core 1 and the E-shaped core 2, without an adhesive layer required when a conventional sheet-like magnet is used. Under the influence of the viscosity and the surface tension of the viscous material, the shape of a side surface of the bond magnet 4*a* is apparently different from the shape of a sheet-like magnet, a press magnet, or the like manufactured by a conventional punching method or the like. Specifically, the bond magnet 4*a* according to this invention is formed in tight contact with the magnetic core without any gap. The side surface of the bond magnet which does not face the magnetic core has a smooth concavo-convex shape obtained after a free surface of the viscous material is hardened as it is, and is formed by a plurality of curvature surfaces.

Figure 8:
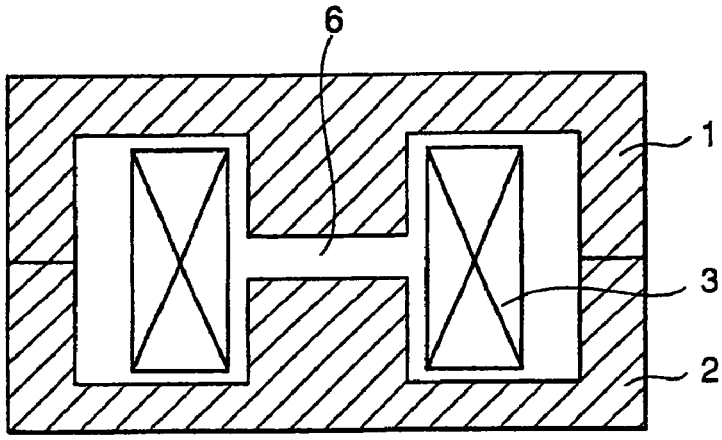
FIG. 8 is a diagram for explaining an inductance device including a pair of E-shaped cores before a sheet-like magnet is mounted.
Figure 9:
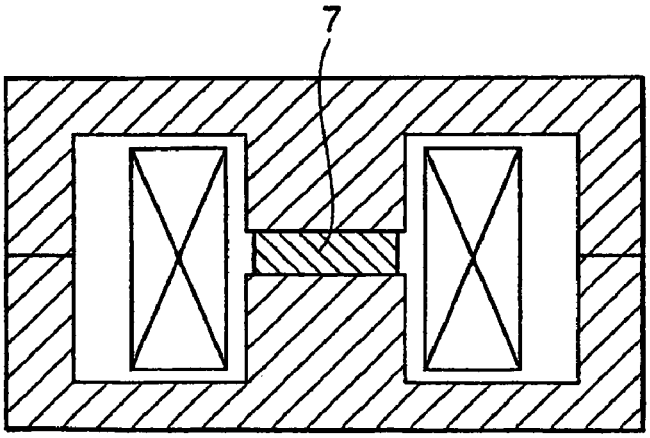
FIG. 9 PRIOR ART
FIG. 9 is a diagram for explaining a conventional inductance device including a pair of E-shaped cores.

For comparison, a sheet-like magnet prepared by a compression molding method was adhered to a Mn—Zn ferrite core similar to that described above to obtain an inductance device as a conventional example. FIG. 8 is a diagram for explaining the inductance device before the sheet-like magnet is mounted. FIG. 9 is a diagram for explaining the inductance device as the conventional example. As is understood from FIGS. 8 and 9, the conventional inductance device is obtained by inserting a sheet-like magnet 7 into a magnetic gap 6 of the Mn—Zn ferrite core and adhering the sheet-like magnet.

Figure 10:
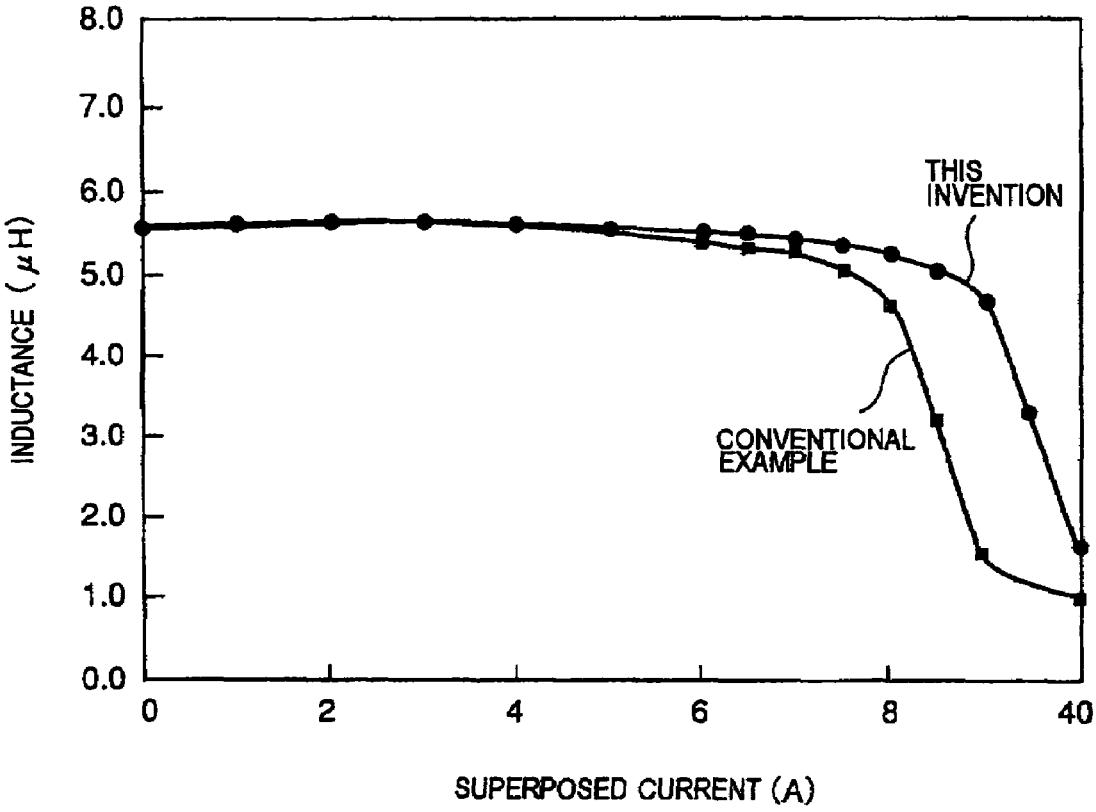
FIG. 10 is a characteristic chart for comparing DC superposition characteristics of the inductance device according to Example 3 of this invention and the conventional inductance device.

FIG. 10 is a characteristic chart for comparison of DC superposition characteristics of the inductance device according to this invention and the conventional inductance device. As shown in FIG. 10, the inductance device according to this invention has a saturation current value higher than that of the conventional inductance device in DC superposition characteristics because the anisotropic bond magnet is formed.

EXAMPLE 4

Figure 11:
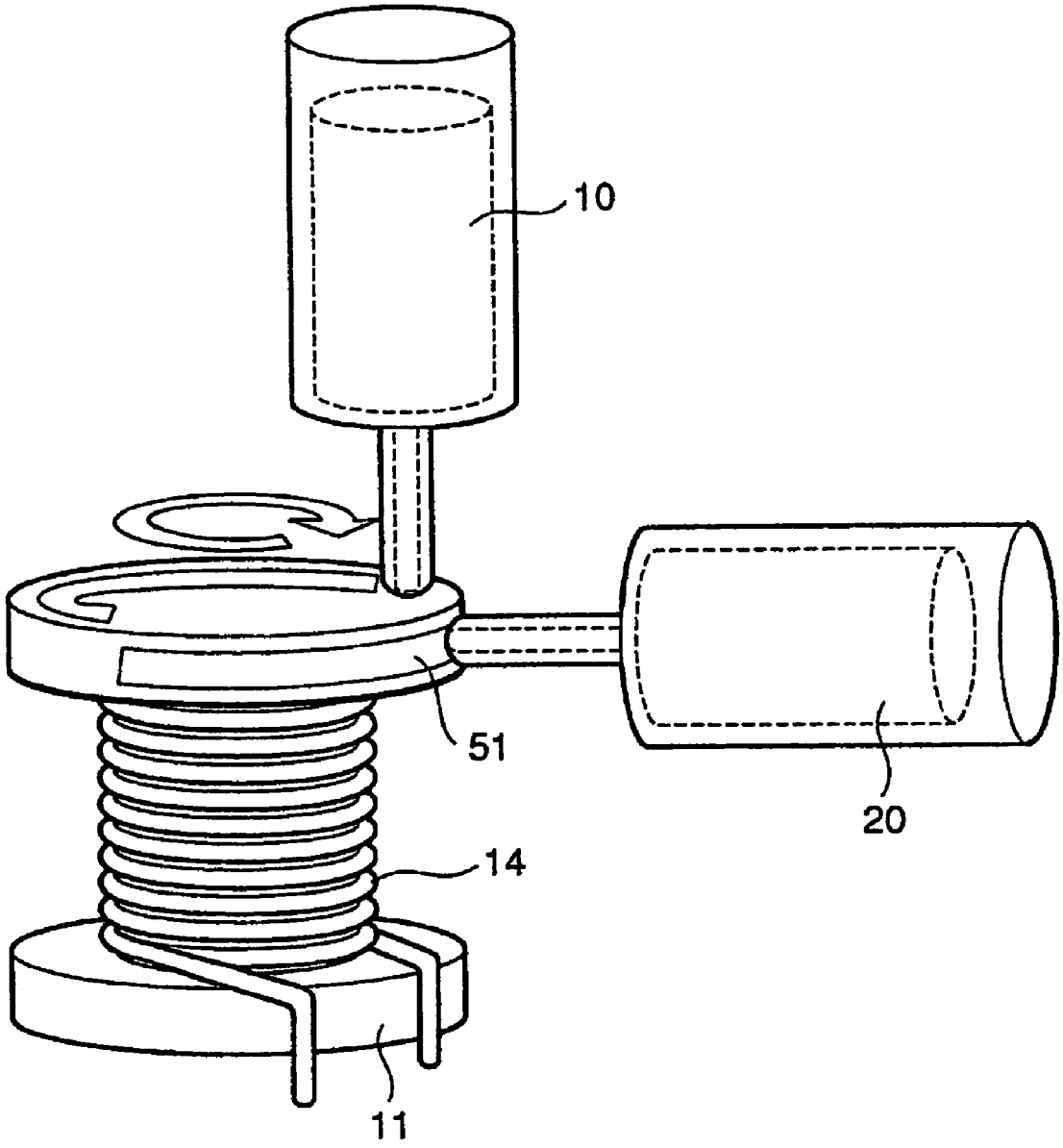
FIG. 11 is a diagram for explaining a method of manufacturing a bond magnet by applying a viscous material on a drum-type core.

FIG. 11 is a diagram for explaining a method of manufacturing a bond magnet by applying a viscous material similar to that described in Examples 1 to 3 on a drum-type core according to Example 4 of this invention. In FIG. 11, a drum-type core 11 is rotated. From a dispenser 10, a viscous material 51 is applied on an end surface in a circumferential direction. From a dispenser 20, a viscous material is applied on an outer peripheral surface of a flange portion in the circumferential direction. In these manners, the viscous material 51 can be applied on the end surfaces or the outer peripheral surface of the drum-type core in a ring-like shape (or a circular shape).

Figure 12:
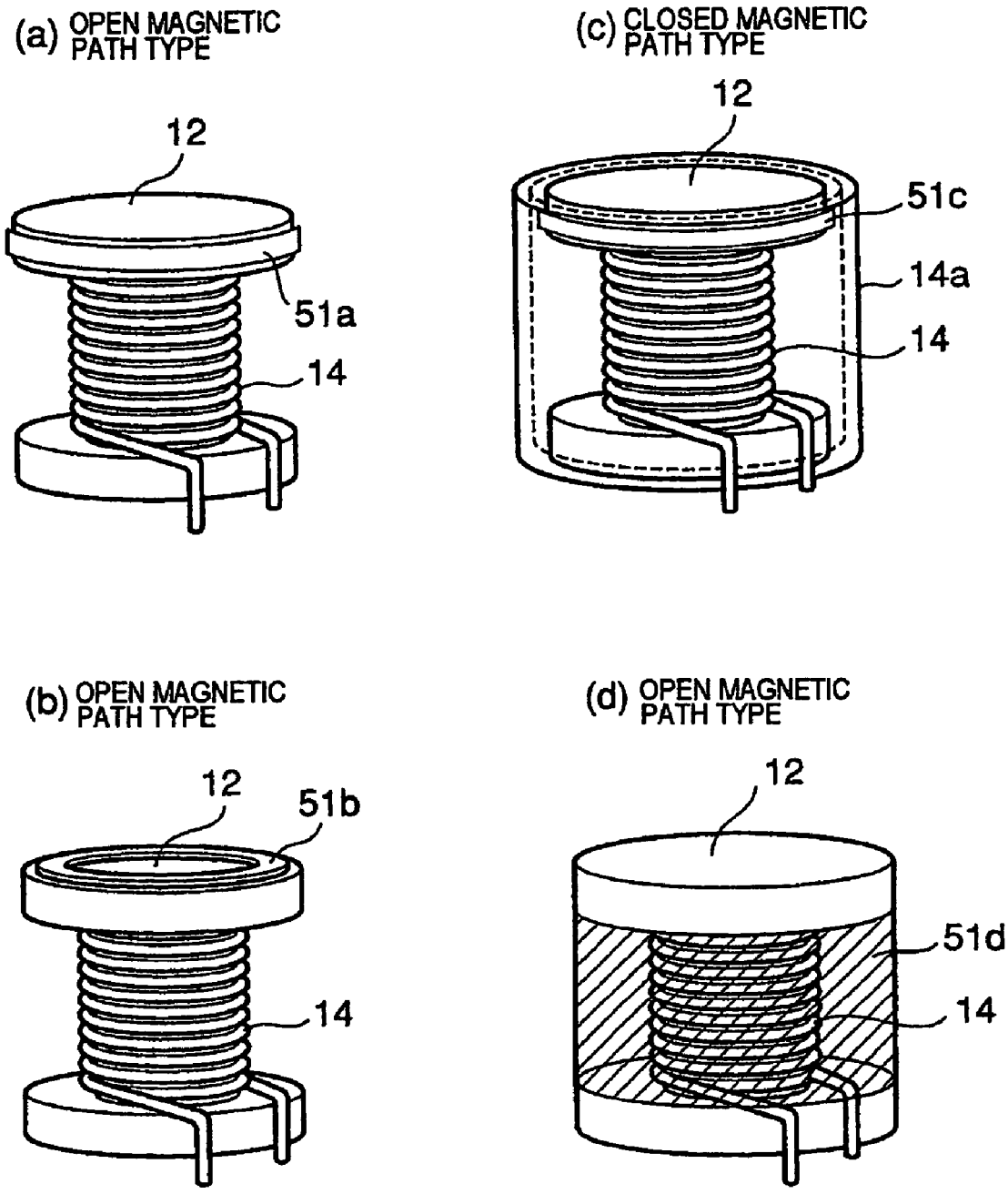
FIG. 12(*a*) is a diagram showing of a drum-type core of an open magnetic path type, including the bond magnet formed by the method in FIG. 6.

FIGS. 12(*a*) to 12(*d*) are diagrams for explaining the drum-type core manufactured by the method in FIG. 11 and provided with a bond magnet. FIG. 12(*a*) is a diagram showing an example of an open magnetic path type in which a viscous material 51*a* is formed on the outer peripheral surface of the flange portion 12 in the circumferential direction. FIG. 12(*b*) is a diagram showing another example of the open magnetic path type in which a viscous material 51*b* is formed on the end surface of the flange portion 12 in the circumferential direction. FIG. 12(*c*) is a diagram showing an example of a closed magnetic path type in which a viscous material 51*c* is formed between the outer peripheral surface of the flange portion 12 and an inner peripheral surface of a cylindrical core 14*a*. FIG. 12(*d*) is a diagram showing still another example of the open magnetic path type in which a viscous material 51*d* is formed to bury a coil 14.

Figure 13:
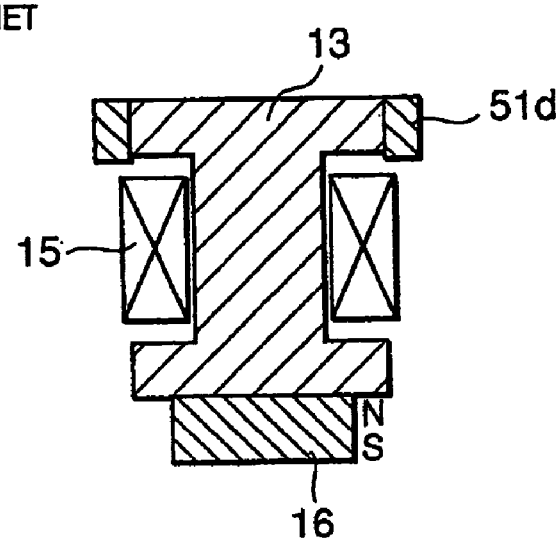
FIG. 13(*a*) is a diagram for explaining a method of applying an orientation magnetic field to a viscous material applied on the drum-type core using a disk magnet.
Figure 13:
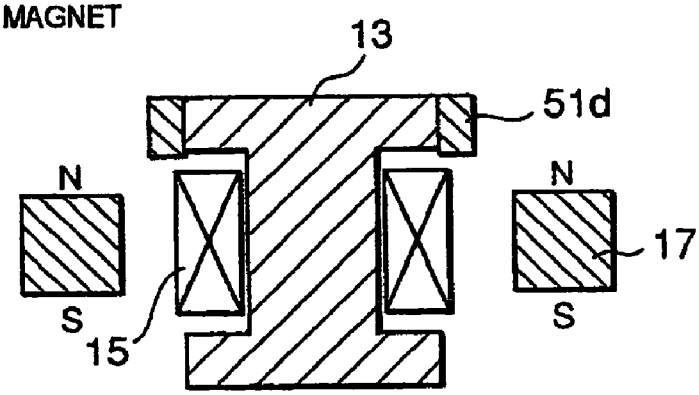
Figure 13:
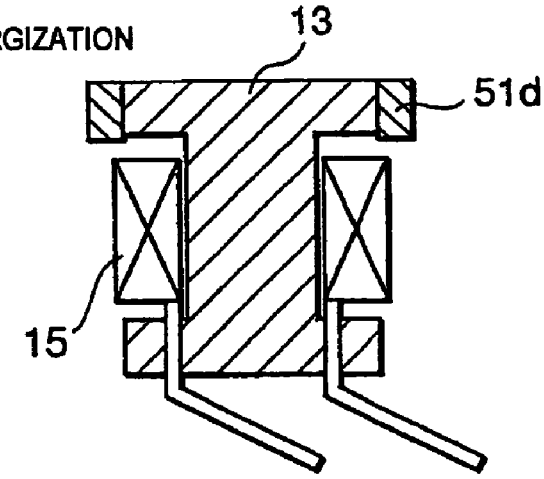

FIG. 13 is a diagram for explaining a method of applying a magnetic field to the viscous material 51*d* applied on a drum-type core 13 according to this invention. FIG. 13(*a*) is a diagram showing the case where a disk magnet 16 is used. FIG. 13(*b*) is a diagram showing the case where a ring magnet 17 is used. FIG. 13(*c*) is a diagram showing the case where the coil 15 is self-energized. In each method, an orientation magnetic field in a radial direction can be applied to the ring-shaped (or circular) viscous material 51*d* applied to the drum-type core 13. Thus, a high-performance bond magnet oriented (magnetized) in the radial direction can be obtained.

EXAMPLE 5

By inserting magnets into gaps of cores same in shape as the core used in Example 2, samples were manufactured. As the magnets, a Ba ferrite sintered magnet, an $Sm_2Fe_{17}N$ bond magnet, and an $Sm_2Co_{17}$ bond magnet were used. Intrinsic coercive forces Hc were 4.0, 5.0, and 10.0 kOe. The average particle size of each of the $Sm_2Fe_{17}N$ alloy magnetic powder and the $Sm_2Co_{17}$ alloy magnetic powder was 3.0 μm. The $Sm_2Fe_{17}N$ bond magnet and the $Sm_2Co_{17}$ bond magnet were prepared in the manner similar to Example 1 after 50 vol % of a polypropylene resin being a thermoplastic resin and having a softening point of about 80° C. was added as a binder to the $Sm_2Fe_{17}N$ alloy magnetic powder and the $Sm_2Co_{17}$ alloy magnetic powder and a resultant mixture was hot-kneaded by a Labo Plastomill. The bond magnets thus prepared were inserted into gap portions of center legs of magnetic cores same in shape as the magnetic core used in Example 2 and made of MnZn ferrite to obtain samples. After the undermentioned measurement, the specific resistances of the bond magnets thus obtained were measured. As a result, the specific resistances were within the range of about 10 to 30 Ω. cm.

The Ba ferrite sintered magnet was processed into a shape corresponding to the gap portion of the center leg of the core. The magnet was inserted into the gap of the core and magnetized in a magnetic path direction by a pulse magnetizer.

Figure 14:
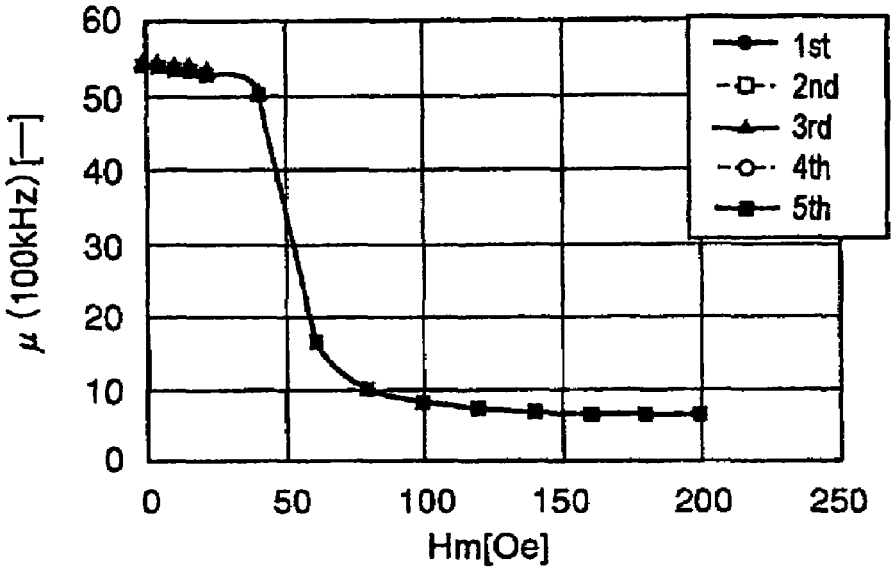
FIG. 14 is a graph showing DC superposition characteristics (magnetic permeability at a magnetic field strength Hm and a frequency 100 kHz) of a core used in Example 5.

Each core was subjected to coil winding. By the use of a HP-4284LCR meter, DC superposition characteristics of the samples were repeatedly measured five times under the conditions of the AC magnetic field frequency of 100 kHz and the superposed magnetic field of 0 to 200 Oe. At this time, a superposed current was applied so that the direction of the DC bias magnetic field was opposite to the orientation direction or the magnetization direction of the magnetized magnet. The permeability was calculated from a core constant and the number of turns of winding. The first through the fifth measurement results of each core are shown in FIGS. 14 to 17. FIG. 14 shows a measurement result of a core without a magnet in a gap for the purpose of comparison.

Figure 15:
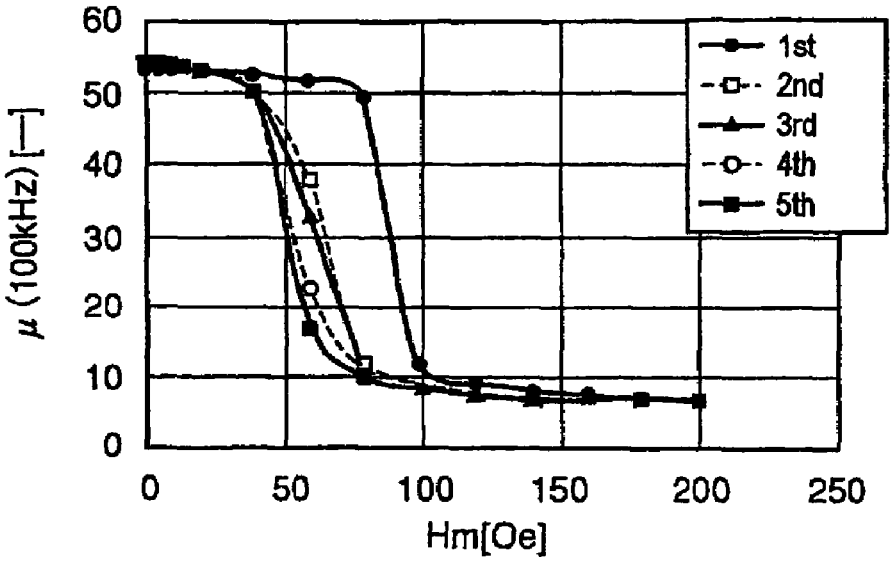
FIG. 15 is a graph showing DC superposition characteristics (magnetic permeability at a magnetic field strength Hm and a frequency 100 kHz) of a core with a Ba ferrite sintered magnet inserted into a gap.
Figure 16:
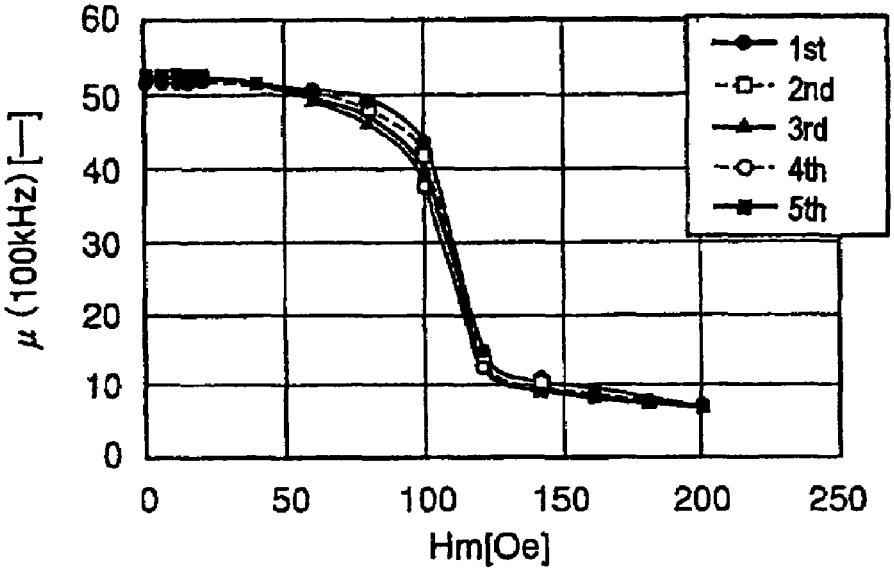
FIG. 16 is a graph showing DC superposition characteristics (magnetic permeability at a magnetic field strength Hm and a frequency 100 kHz) of a core with an $Sm_2Fe_{17}N$ bond magnet inserted into a gap.
Figure 17:
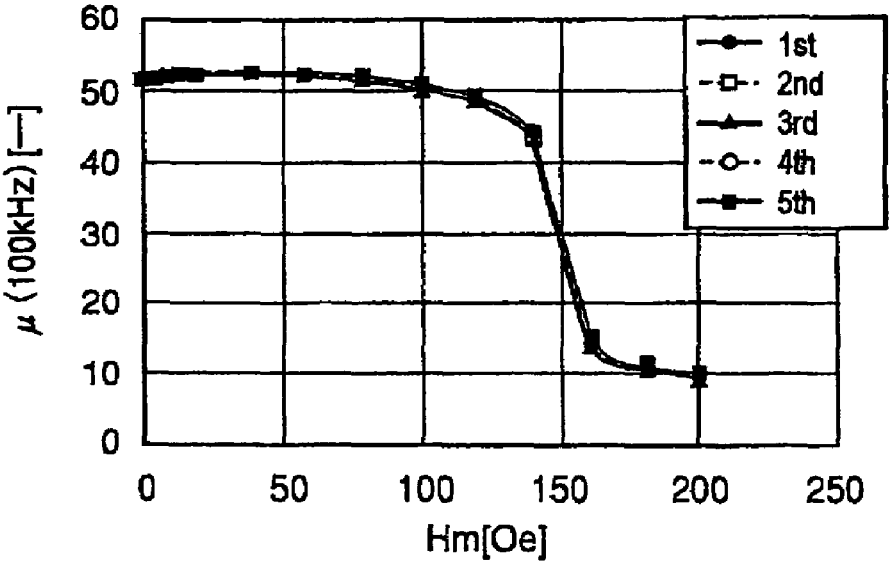
FIG. 17 is a graph showing DC superposition characteristics (magnetic permeability at a magnetic field strength Hm and a frequency 100 kHz) of a core with an $Sm_2Co_{17}$ bond magnet inserted into a gap.

Referring to FIG. 15, it is understood that, in the core in which a ferrite magnet having a coercive force as small as 4 kOe was inserted, the DC superposition characteristic is considerably deteriorated as the number of times of measurement is increased. On the other hand, referring to FIGS. 16 and 17, it is understood that those cores in which a bond magnet having a large coercive force exhibit a very stable characteristic without substantial change even in repeated measurements.

From the above-mentioned results, it is assumed that, since the ferrite magnet has a small coercive force, demagnetization or magnetic reversal is caused by a reverse magnetic field applied to the magnet and, therefore, the DC superposition characteristic is deteriorated. Furthermore, it has been understood that the DC superposition characteristic is excellent if the magnet inserted (or formed) in the core is a rare earth bond magnet having a coercive force of 5 kOe or more.

EXAMPLE 6

Bond magnets were prepared in the manner similar to Example 5 after 40 vol % of a polyethylene resin as a binder was added to $Sm_2Co_{17}$ alloy magnetic powders having average particle sizes of about 1.0 μm, 2.0 μm, 25 μm, 50 μm, and 75 μm and a resultant mixture was hot-kneaded by a Labo Plastomill. The characteristics of the bond magnets were measured by a VSM and corrected using demagnetizing field coefficients of the powders. As a result, it was found out that the intrinsic coercive force of 5 kOe or more was obtained for all the magnets. In the manner similar to Example 5, the bond magnets were inserted into gaps of cores. By the use of an SY-8232 AC BH tracer manufactured by Iwatsu Electric, core loss characteristics were measured at 300 kHz and 0.1 T at a room temperature. Herein, the ferrite cores used in measurement had substantially same characteristics. The results of measurement of the core loss are shown in Table 2. For comparison, the result of measurement for a core without a magnet inserted in a gap is also shown in Table 2. After measurement of the core loss, the inserted magnets were taken out and the surface magnetic flux of each magnet was measured by TOEI: TDF-5. The measured value and the surface magnetic flux calculated from the size of the magnet are shown in Table 2.

In Table 2, the core loss is large at the average particle size of 1.0 μm because oxidation of the alloy magnetic powder is promoted since the surface area of the alloy magnetic powder is large. The core loss is large at the average particle size of 75 μm because an eddy-current loss becomes large since the average particle size of the alloy magnetic powder is large. The surface magnetic flux is high at the average particle size of 1.0 μm because magnetization is difficult due to a large coercive force.

TABLE 2

| | particle size (μm) | | | | | |
|---|---|---|---|---|---|---|
| | no magnet (gap) | 1.0 | 2.0 | 25 | 50 | 75 |
| core loss ($KW/m^3$) | 520 | 650 | 530 | 535 | 555 | 870 |
| surface magnetic flux of magnet (Gauss) | — | 130 | 200 | 203 | 205 | 209 |

EXAMPLE 7

By inserting magnets into gaps of cores same in shape as the core used in Example 2, samples were manufactured. As the magnets, a Ba ferrite sintered magnet, an $Sm_2Fe_{17}N$ bond magnet, and an $Sm_2Co_{17}$ bond magnet were used. Intrinsic coercive forces Hc were 5.0, 8.0, and 17.0 kOe. The average particle size of each of the $Sm_2Fe_{17}N$ alloy magnetic powder and the $Sm_2Co_{17}$ alloy magnetic powder was 3 to 3.5 μm. The $Sm_2Fe_{17}N$ bond magnet and the $Sm_2Co_{17}$ bond magnet were prepared by mixing each of the $Sm_2Fe_{17}N$ alloy magnetic powder and the $Sm_2Co_{17}$ alloy magnetic powder and 50 vol % of a polyimide resin being a thermoplastic resin and having a softening point of about 300° C. as a binder. Then, in the manner same as Example 2, the bond magnets were inserted into gap portions of center legs of magnetic cores made of MnZn ferrite and similar to the magnetic core used in Example 5 to obtain samples. After the under-mentioned measurement, the specific resistances of the bond magnets were measured. As a result, the specific resistances were within the range of about 10 to 30 Ω.cm.

The Ba ferrite sintered magnet was processed into a shape corresponding to the gap portion of the center leg of the core. The magnet was inserted into the gap of the core and magnetized in a magnetic path direction by a pulse magnetizer.

Figure 18:
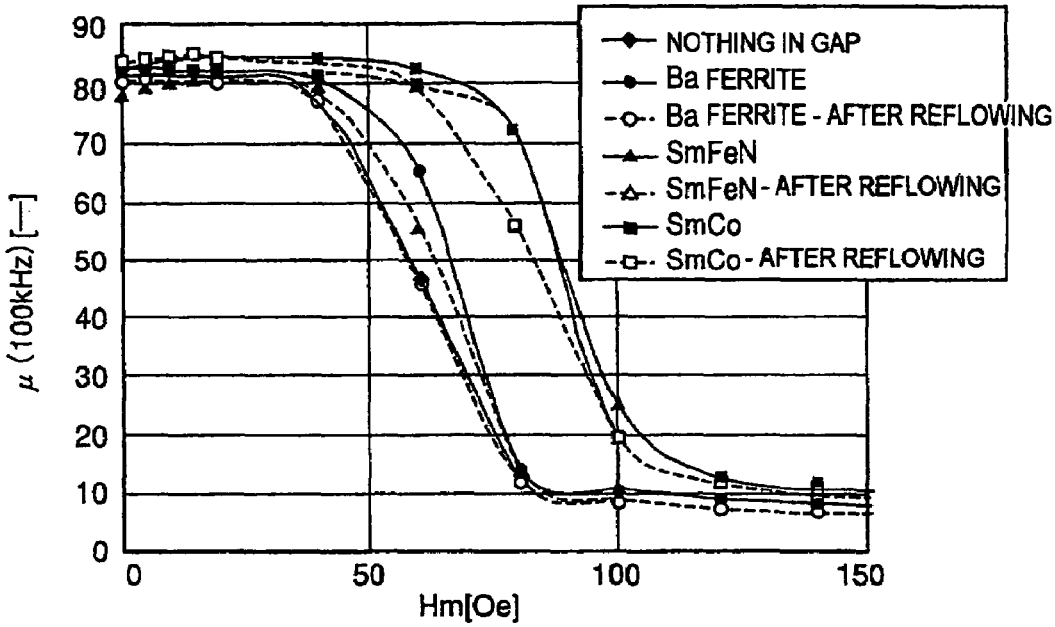
FIG. 18 is a graph showing a difference between DC superposition characteristics (magnetic permeability at a magnetic field strength Hm and a frequency 100 kHz) of cores before and after reflowing, depending on a difference in intrinsic coercive force among magnets inserted into gaps.

Each core was subjected to coil winding. By the use of an LCR meter, DC superposition characteristics of the samples were measured. The permeability was calculated from a core constant and the number of turns of winding. The results are shown in FIG. 18. Aafter measurement, each sample was held in a constant-temperature bath at 270° C. as a condition of a reflow furnace for 1 hour, then cooled to a room temperature, and left for 2 hours. Thereafter, in the manner similar to that mentioned above, the DC superposition characteristics of the samples were measured by the LCR meter. The results are also shown in FIG. 18.

As a comparative example, a sample without a magnet inserted in a gap portion was prepared in the manner similar to that described above.

From FIG. 18, it is understood that, in all the samples with the magnets inserted or formed in the gaps, the DC superposition characteristics are improved as compared with the sample in which nothing is inserted into the gap. On the other hand, after reflowing, the DC superposition characteristics are deteriorated in the samples in which the Ba ferrite sintered magnet and the $Sm_2Fe_{17}N$ bond magnet, each having a low coercive force Hc, are inserted into the gaps. This is because thermal demagnetization easily occurs since the intrinsic coercive force Hc is low. Further, it is understood that the $Sm_2Co_{17}$ bond magnet having a high coercive force Hc is kept superior even after reflowing.

EXAMPLE 8

As alloy magnetic powders of bond magnets, use was made of an $Nd_2Fe_{14}B$ alloy magnetic powder having a Curie temperature Tc=310° C., an $Sm_2Fe_{17}N$ alloy magnetic powder having Tc=400° C., and an $Sm_2Co_{17}$ alloy magnetic powder having Tc=770° C. The alloy magnetic powders had an average particle size of 3 to 3.5 μm. To each alloy magnetic powder, 50 vol % of a polyimide resin being a thermoplastic resin and having a softening point of about 300° C. was added as a binder and mixed. Thereafter, in the manner similar to Example 5, the bond magnets were arranged in the center legs of ferrite magnetic cores. After the under-mentioned measurement, the specific resistances of the bond magnet were measured. As a result, the specific resistances were within the range of about 10 to 30 Ω.cm.

Figure 19:
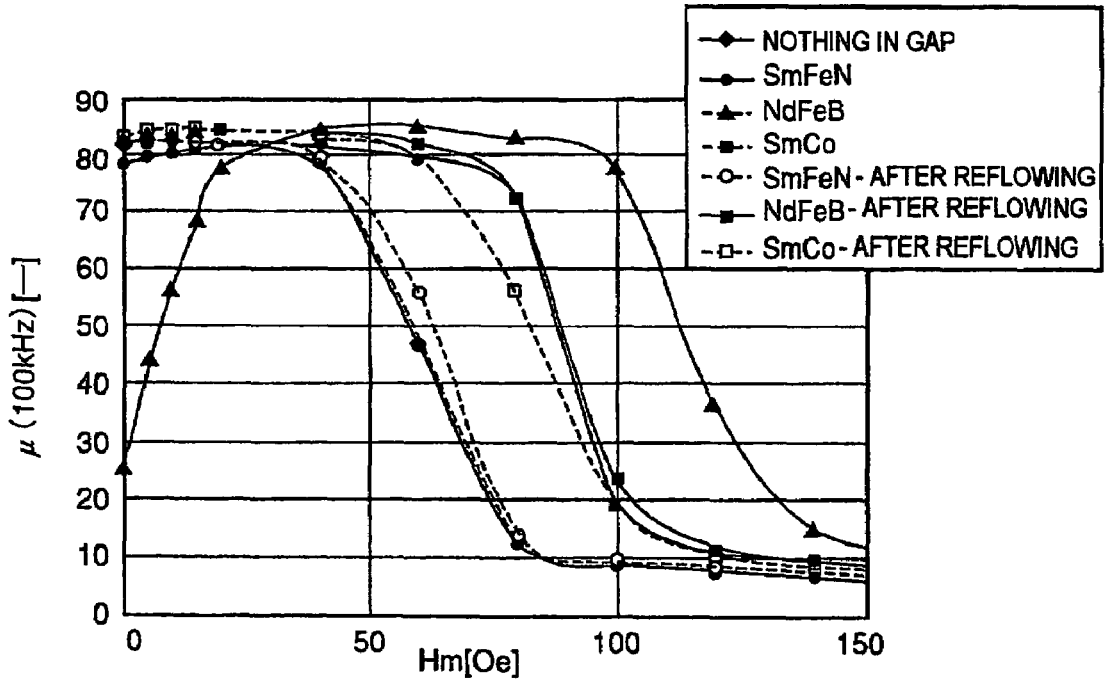
FIG. 19 is a graph showing a difference between DC superposition characteristics (magnetic permeability at a magnetic field strength Hm and a frequency 100 kHz) of cores before and after reflowing, depending on a difference in Curie temperature among magnets inserted into gaps.

Then, each core was subjected to coil winding. By the use of an LCR meter, DC superposition characteristics of the samples were measured. The permeability was calculated from a core constant and the number of turns of winding. The results are shown in FIG. 19. After measurement, each sample was held in a constant-temperature bath at 270° C. as a condition of a reflow furnace for 1 hour, and cooled to a room temperature. Thereafter, in the manner similar to that mentioned above, the DC superposition characteristics of the samples were measured by the LCR meter. The results are also shown in FIG. 19. As a comparative example, a sample without a magnet inserted in a gap portion was prepared in the manner similar to that described above.

From FIG. 19, it is understood that, in all the samples with the magnets inserted (or formed) in the gaps, the DC superposition characteristics are improved as compared with the sample in which nothing is inserted into the gap. On the other hand, after reflowing, the DC superposition characteristics are deteriorated in the samples in which the $Nd_2Fe_{14}B$ bond magnet and the $Sm_2Fe_{17}N$ bond magnet, each having a low Curie temperature Tc, are inserted and no superiority is observed to the sample in which nothing is inserted. Further, it is understood that the $Sm_2Co_{17}$ bond magnet having a high Curie temperature Tc is kept superior even after reflowing.

EXAMPLE 9

A $SM_2Co_{17}$-based sintered magnet having an energy product of about 28 MGOe was coarsely ground and then finely ground by a ball mill in an organic solvent. By changing the fine grinding time, alloy magnetic powders having average particle sizes 150 μm, 100 μm, 50 μm, 10 μm, 5.6 μm, 3.3 μm, 2.4 μm, and 1.8 μm were prepared. The alloy magnetic powders thus prepared were magnetized to obtain magnetic alloy powders. Thereafter, 10 wt % of an epoxy resin was mixed as a binder with each of the magnetic alloy powders to prepare bond magnets in the manner similar to Example 1. The characteristics of the bond magnets were measured by a VSM and corrected using demagnetization coefficients of the magnetic alloy powders. The corrected values are shown in Table 3. Further, the specific resistances were identified and, as a result, all the magnets exhibited the values of 1 Ω.cm or more. The magnets were inserted into gaps of MnZn-based ferrite cores in the manner similar to Example 5. The core losses of the samples were measured under the conditions of 300 kHz-1000 G and a room temperature. The results are shown in Table 4.

TABLE 3

| | average particle size | | | | | | | |
|---|---|---|---|---|---|---|---|---|
| | 150 μm | 100 μm | 50 μm | 10 μm | 5.6 μm | 3.3 μm | 2.5 μm | 1.8 μm |
| Br(Kg) | 3.5 | 3.4 | 3.3 | 3.1 | 3.0 | 2.8 | 2.6 | 2.2 |
| Hc(kOe) | 25.6 | 24.5 | 23.2 | 21.5 | 19.3 | 16.4 | 12.5 | 9.5 |

TABLE 4

| | average particle size | | | | | | | | |
|---|---|---|---|---|---|---|---|---|---|
| | no magnet | 150 μm | 100 μm | 50 μm | 10 μm | 5.6 μm | 3.3 μm | 2.5 μm | 1.8 μm |
| core loss ($kW/m^3$) | 520 | 1280 | 760 | 570 | 560 | 555 | 550 | 520 | 520 |

Figure 20:
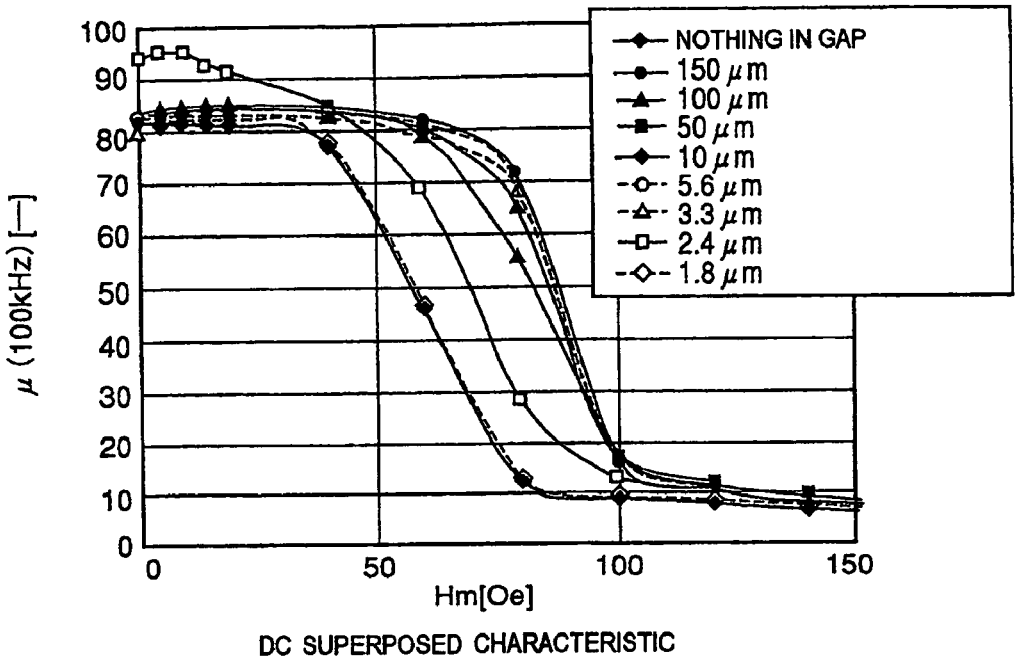
FIG. 20 is a graph showing a difference between DC superposition characteristics (magnetic permeability at a magnetic field strength Hm and a frequency 100 kHz) of cores before and after reflowing, depending on a difference in average particle size among magnets inserted into gaps.

Next, the samples were held in a constant-temperature bath at 270° C. as a condition of a reflow furnace for 1 hour, and then cooled to a room temperature. Thereafter, the DC superposition characteristics of the samples were measured by the LCR meter. The results are shown in FIG. 20. As a comparative example, a sample in which nothing was inserted in a gap portion was manufactured in the manner similar to that described above.

As shown in Table 4, it has been understood that, if the maximum particle size of the magnetic alloy powder exceeds 50 μm, the core loss is sharply increased. From FIG. 20, the DC superposition characteristics are deteriorated at the particle size smaller than 2.5 μm after reflowing. Therefore, it has been understood that, at an average particle size of 2.5 to 50 μm, a magnetic core which is capable of achieving an excellent DC superposition characteristic even after reflowing and which is prevented from deterioration of the core loss can be obtained.

EXAMPLE 10

An $Sm_2Co_{17}$-based sintered magnet containing 0.01 at % Zr, having a composition of $Sm(Co_{0.78}Fe_{0.11}Cu_{0.10}Zr_{0.01})_{7.4}$, and called a second-generation $Sm_2Co_{17}$ magnet and a sintered magnet containing 0.03 at % Zr, having a composition of $Sm(Co_{0.742}Fe_{0.20}Cu_{0.07}Zr_{0.03})_{7.5}$, and called a third-generation $Sm_2Co_{17}$ magnet were used. The second-generation $Sm_2Co_{17}$ magnet was subjected to aging at 800° C. for 1.5 hours. The third-generation $Sm_2Co_{17}$ magnet was subjected to aging at 800° C. for 10 hours. The coercive forces of the second-generation sintered magnet and the third-generation sintered magnet were 8 kOe and 20 kOe, respectively. These sintered magnets were coarsely ground and then finely ground by a ball mill in an organic solvent to obtain magnetic alloy powders. The magnetic alloy powders thus prepared were magnetized to obtain alloy magnetic powders. 50 vol % of an epoxy resin was mixed as a binder with each of the alloy magnetic powders. Thus, bond magnets were prepared in the manner similar to Example 1.

Next, the bond magnets were inserted into gaps of MnZn-based ferrite cores in the manner similar to Example 5 and subjected to coil winding. By the use of the LCR meter, the DC superposition characteristic of each sample was measured. The permeability was calculated from the core constant and the number of turns of windings. The results are shown in FIG. 21.

After measurement, the samples were held in a constant-temperature bath at 270° C. as a condition of a reflow furnace for 1 hour, and cooled to a room temperature. Thereafter, in the manner similar to that mentioned above, the DC superposition characteristics of the samples were measured by the LCR meter. The results are also shown in FIG. 21.

Figure 21:
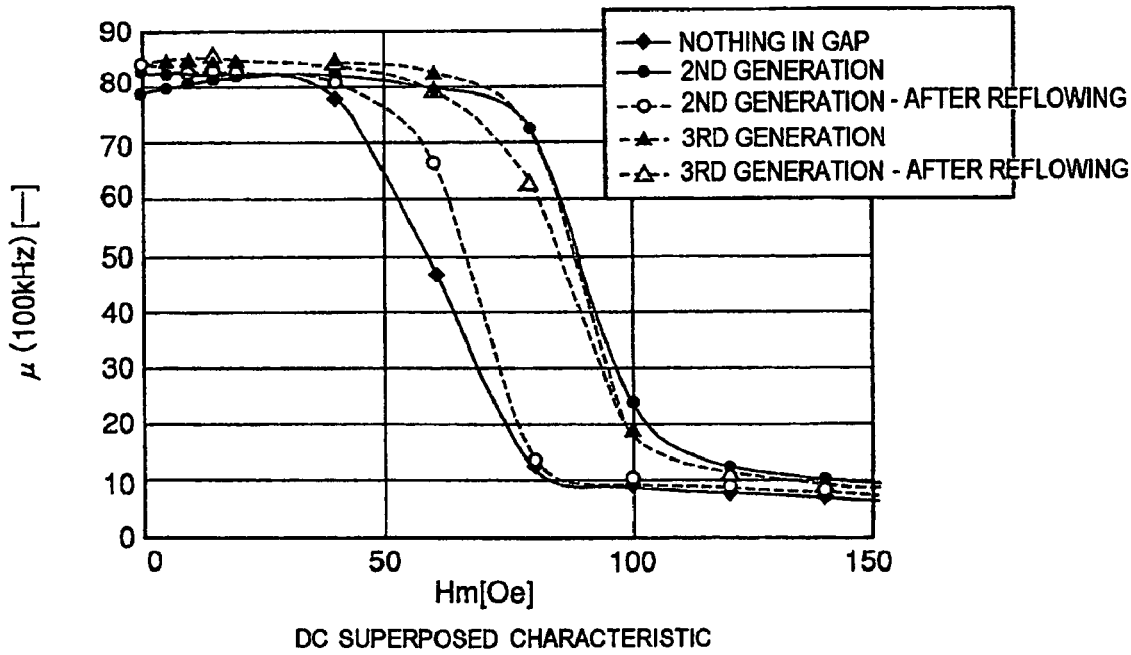
FIG. 21 is a graph showing a difference between DC superposition characteristics (magnetic permeability at a magnetic field strength Hm and a frequency 100 kHz) of cores before and after reflowing, depending on a difference in composition among magnets inserted into gaps.
Figure 22:
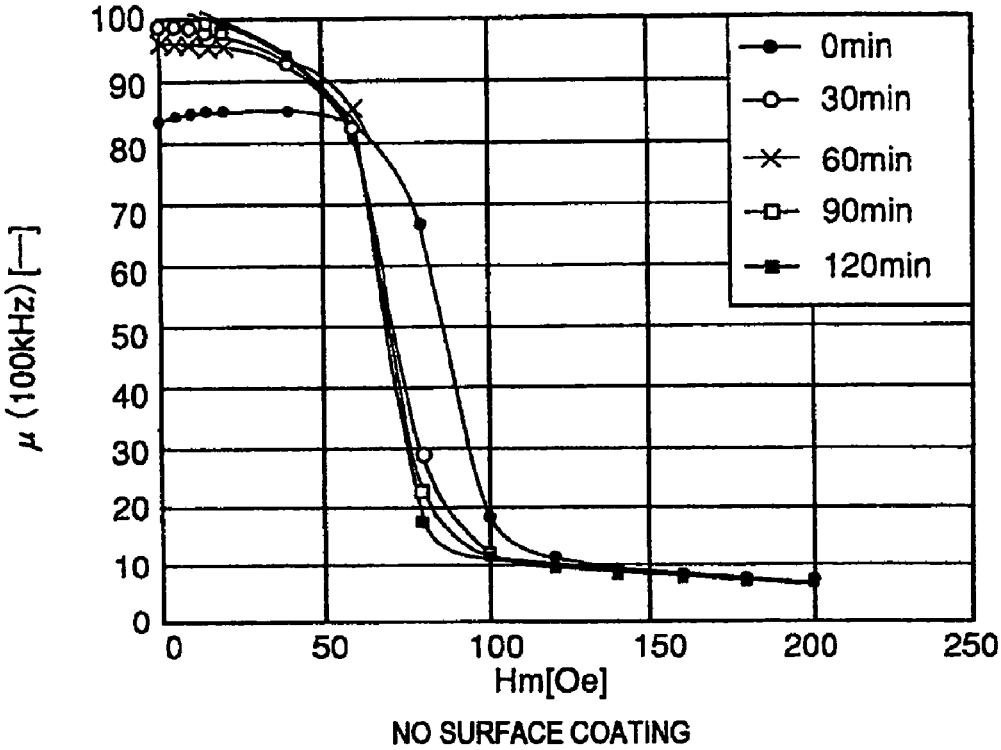
FIG. 22 is a graph showing a change in DC superposition characteristics (magnetic permeability at a magnetic field strength Hm and a frequency 100 kHz) when heat treatment is performed upon a core in which a magnet prepared by using a magnetic alloy powder having a surface not coated with a metal is inserted into a gap.
Figure 23:
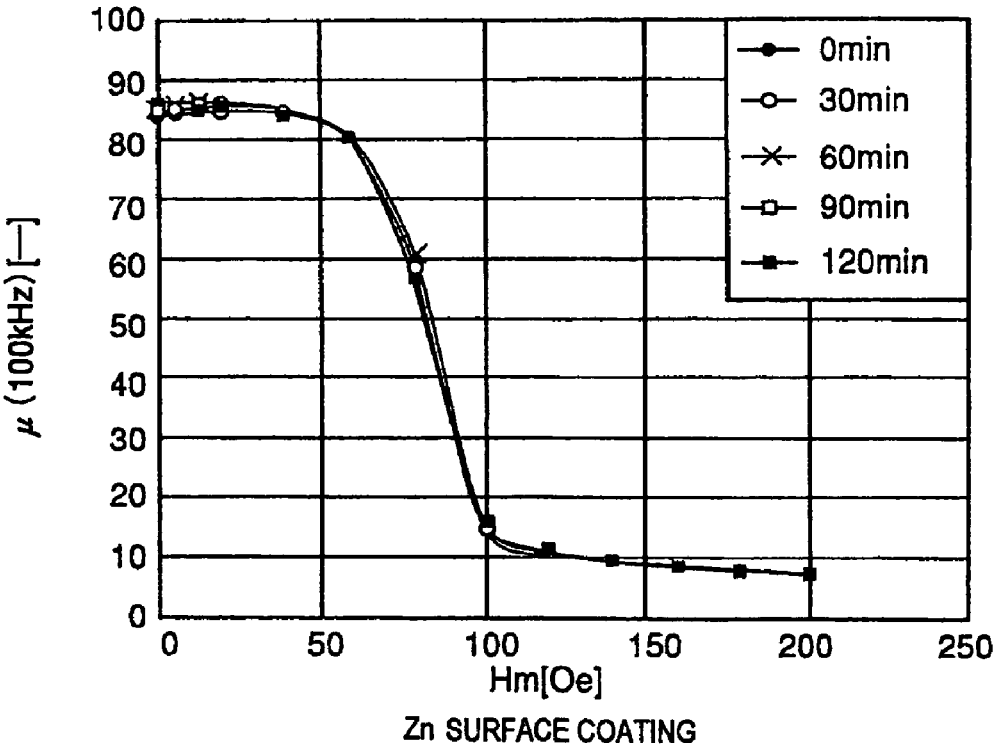
FIG. 23 is a graph showing a change in DC superposition characteristics (magnetic permeability at a magnetic field strength Hm and a frequency 100 kHz) when heat treatment is performed upon a core in which a magnet prepared by using a magnetic alloy powder having a surface coated with Zn is inserted into a gap.
Figure 24:
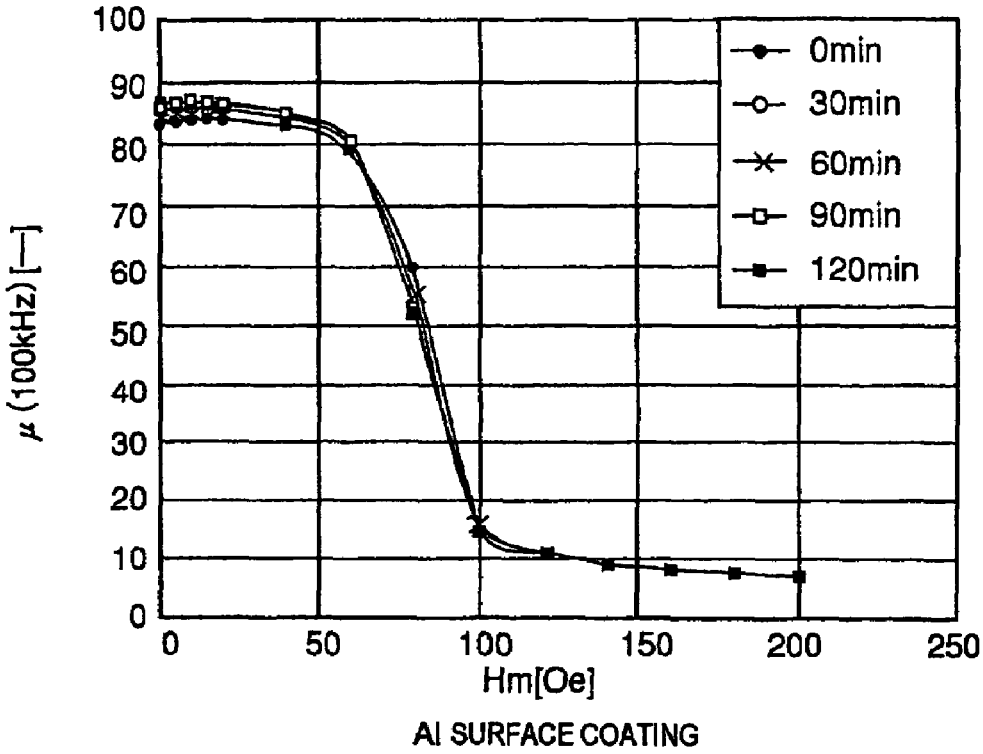
FIG. 24 is a graph showing a change in DC superposition characteristics (magnetic permeability at a magnetic field strength Hm and a frequency 100 kHz) when heat treatment is performed upon a core in which a magnet prepared by using a magnetic alloy powder having a surface coated with Al is inserted into a gap.
Figure 25:
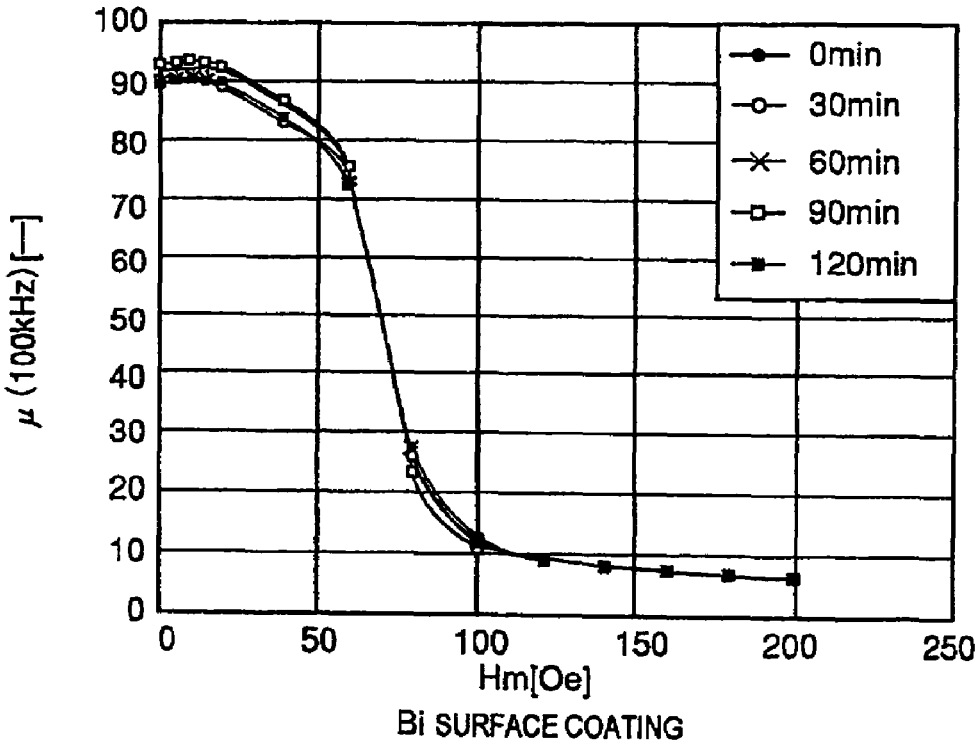
FIG. 25 is a graph showing a change in DC superposition characteristics (magnetic permeability at a magnetic field strength Hm and a frequency 100 kHz) when heat treatment is performed upon a core in which a magnet prepared by using a magnetic alloy powder having a surface coated with Bi is inserted into a gap.
Figure 26:
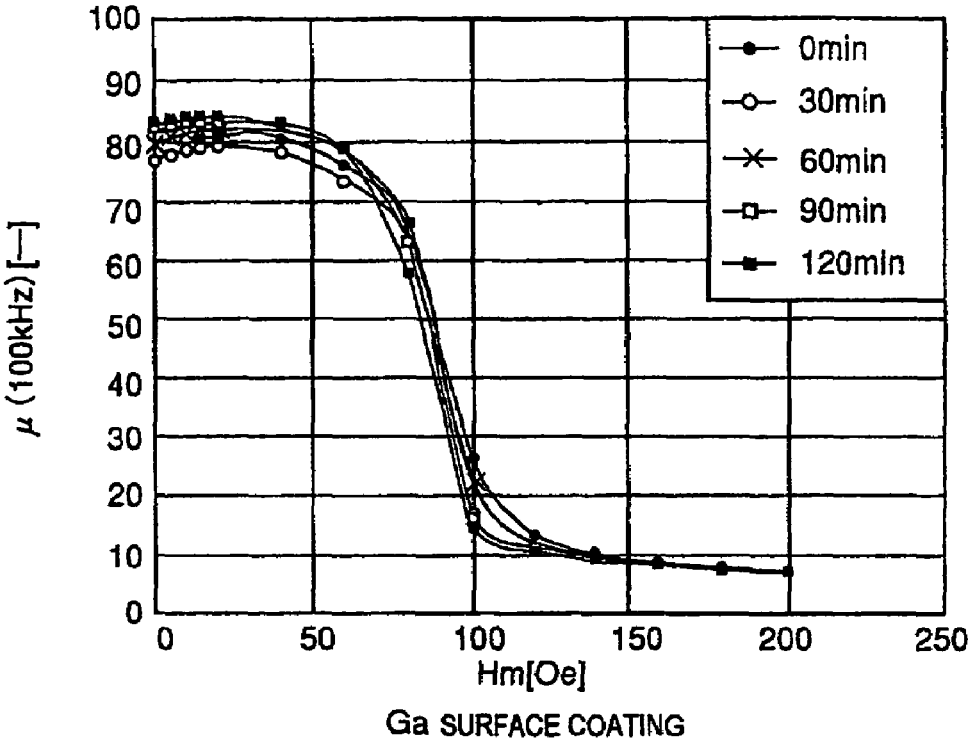
FIG. 26 is a graph showing a change in DC superposition characteristics (magnetic permeability at a magnetic field strength Hm and a frequency 100 kHz) when heat treatment is performed upon a core in which a magnet prepared by using a magnetic alloy powder having a surface coated with Ga is inserted into a gap.
Figure 27:
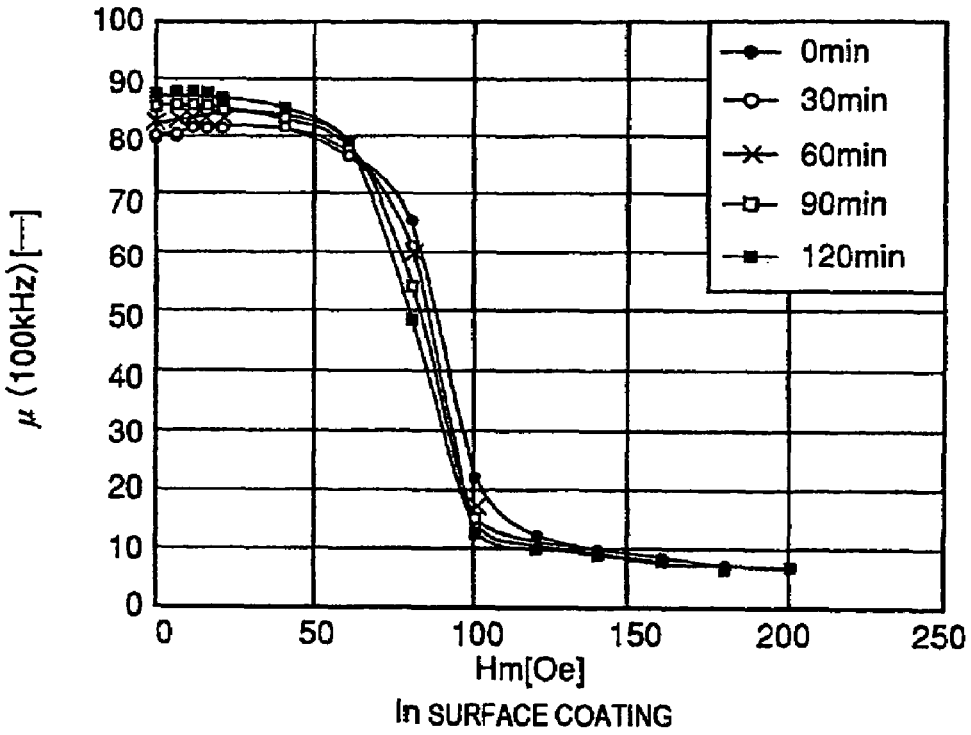
FIG. 27 is a graph showing a change in DC superposition characteristics (magnetic permeability at a magnetic field strength Hm and a frequency 100 kHz) when heat treatment is performed upon a core in which a magnet prepared by using a magnetic alloy powder having a surface coated with In is inserted into a gap.
Figure 28:
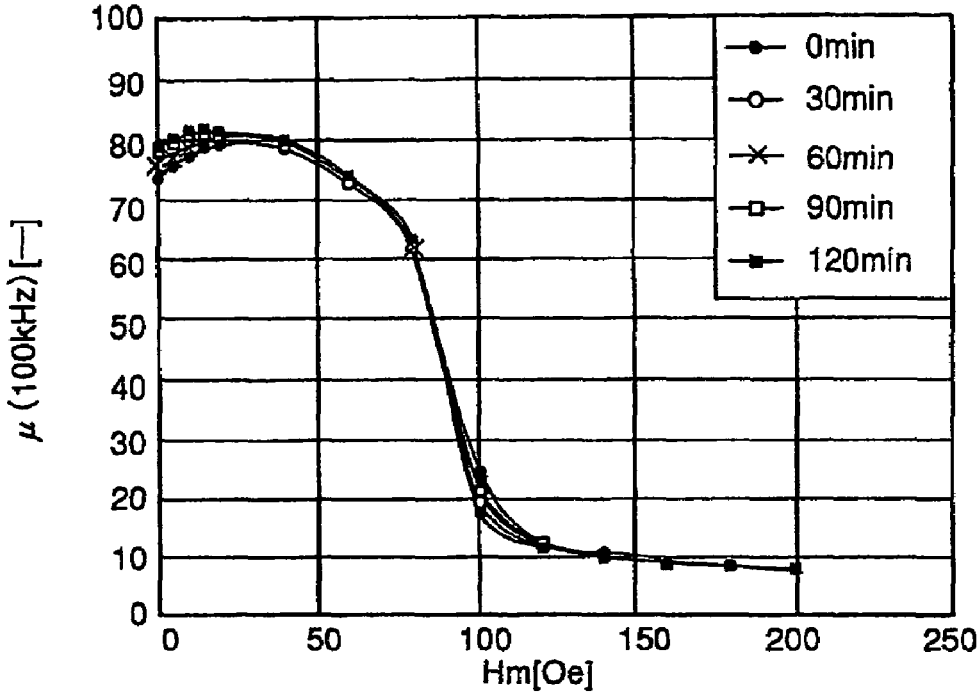
FIG. 28 is a graph showing a change in DC superposition characteristics (magnetic permeability at a magnetic field strength Hm and a frequency 100 kHz) when heat treatment is performed upon a core in which a magnet prepared by using a magnetic alloy powder having a surface coated with Mg is inserted into a gap.
Figure 29:
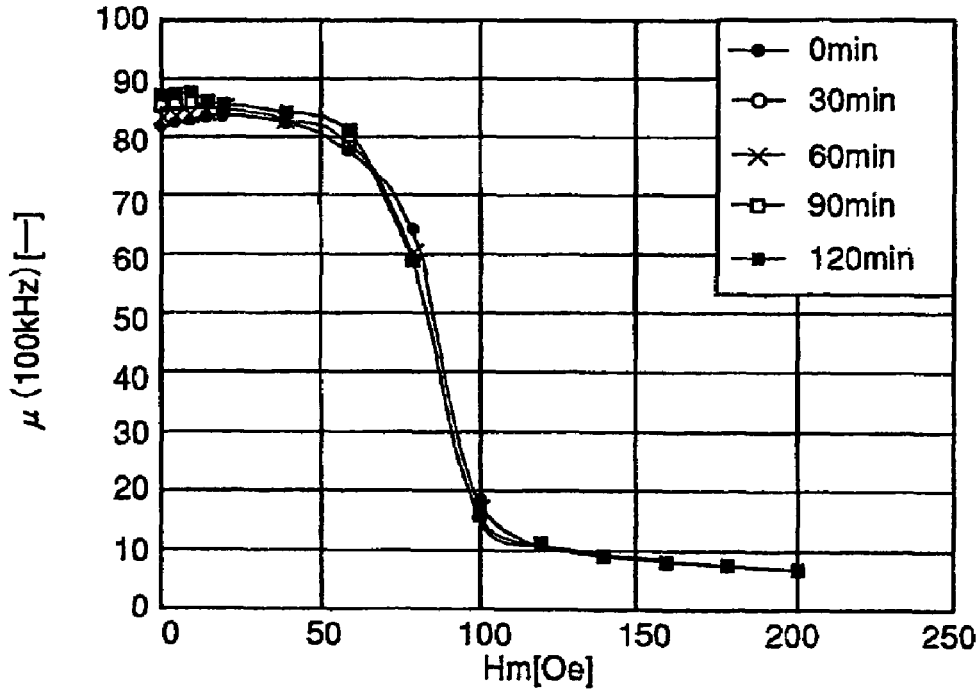
FIG. 29 is a graph showing a change in DC superposition characteristics (magnetic permeability at a magnetic field strength Hm and a frequency 100 kHz) when heat treatment is performed upon a core in which a magnet prepared by using a magnetic alloy powder having a surface coated with Pd is inserted into a gap.
Figure 30:
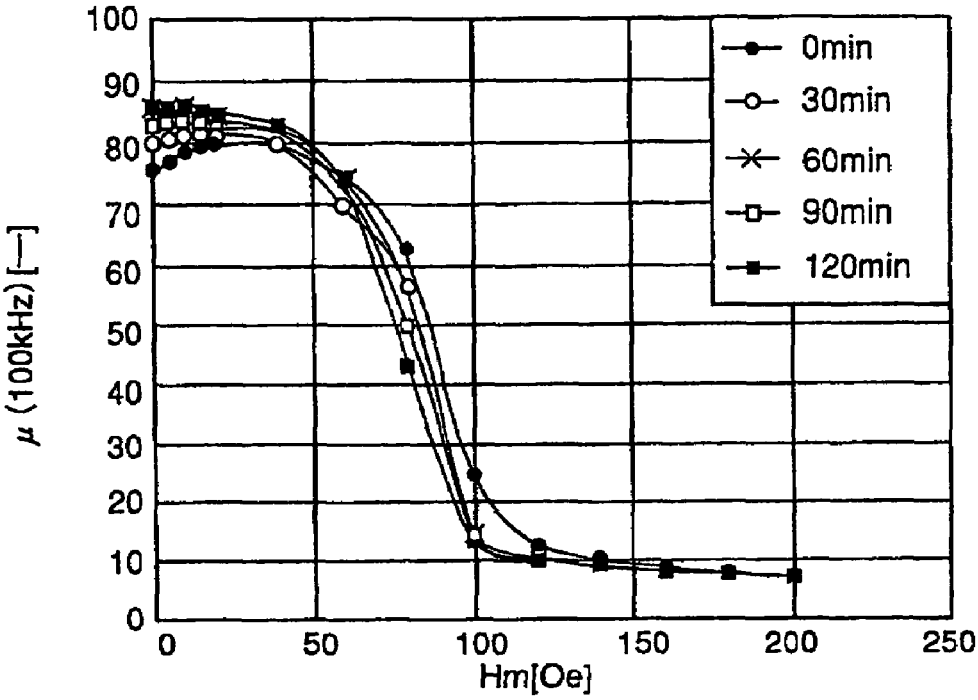
FIG. 30 is a graph showing a change in DC superposition characteristics (magnetic permeability at a magnetic field strength Hm and a frequency 100 kHz) when heat treatment is performed upon a core in which a magnet prepared by using a magnetic alloy powder having a surface coated with Sb is inserted into a gap.
Figure 31:
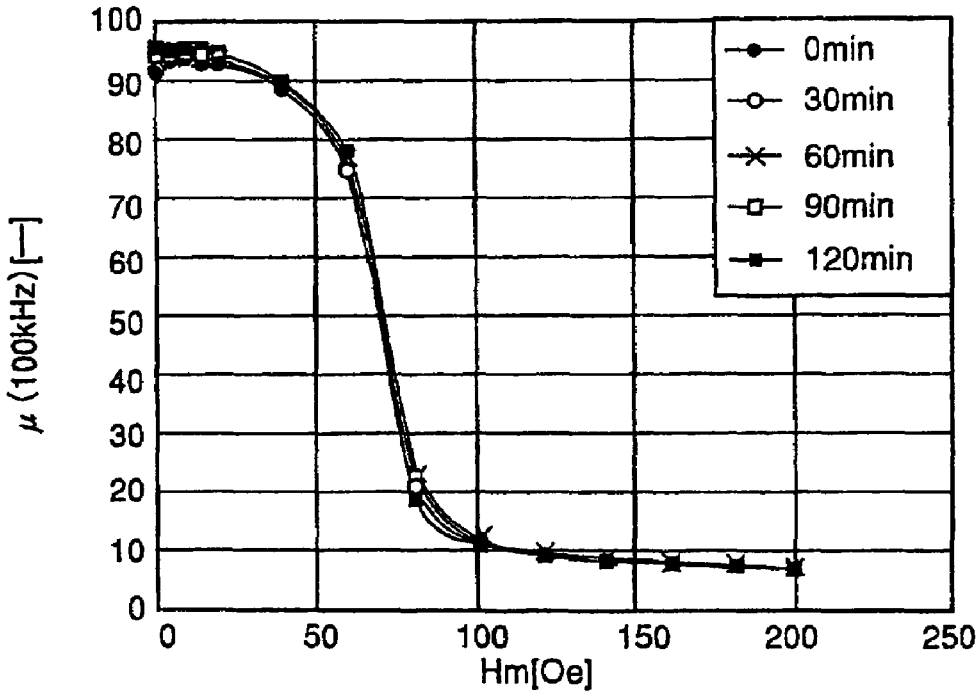
FIG. 31 is a graph showing a change in DC superposition characteristics (magnetic permeability at a magnetic field strength Hm and a frequency 100 kHz) when heat treatment is performed upon a core in which a magnet prepared by using a magnetic alloy powder having a surface coated with Sn is inserted into a gap.
Figure 32:
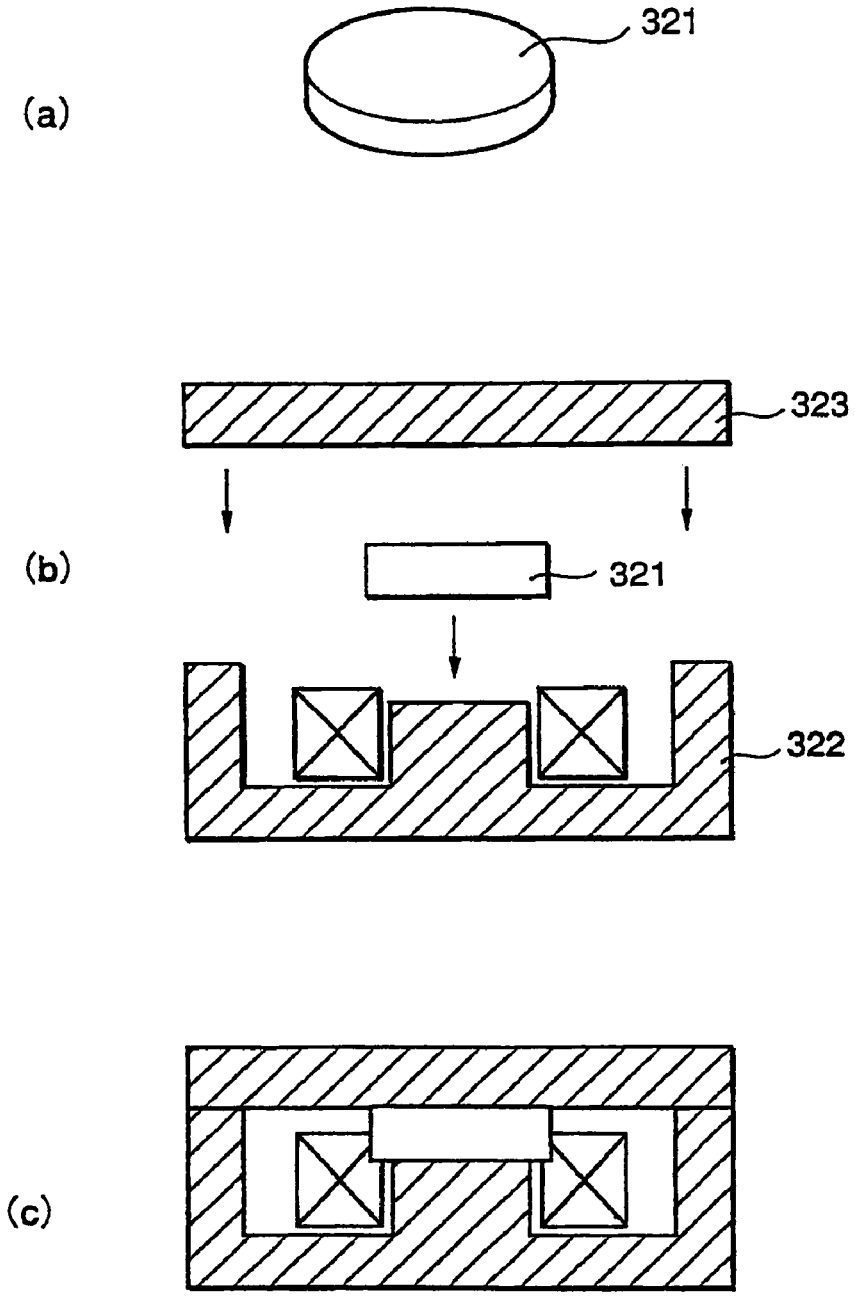
FIG. 32 PRIOR ART
FIGS. 32 (*a*) to (*c*) are diagrams for explaining a conventional method of manufacturing a magnetic device.

From FIG. 21, it has been understood that, if the third-generation $Sm_2Co_{17}$ magnet powder having a high coercive force is used, an excellent DC superposition characteristic can be obtained even after reflowing. From the above, it has been understood that the DC superposition characteristic is excellent in an $Sm(Co_{bal.}Fe_{0.15-0.25}Cu_{0.06-0.08}Zr_{0.02-0.03})_{7.0-8.5}$ magnet having a third-generation composition.

EXAMPLE 11

5 wt % of each of metals Zn, Al, bi, Ga, In, Mg, Pb, Sb, and Sn was mixed with an Sm—Co alloy magnetic powder (average particle size of about 3 μm). The resultant mixtures were subjected to heat treatment for 2 hours in an Ar atmosphere. As a result, the surfaces of the alloy magnetic powders were coated with the respective metals. Heat treatment temperatures are shown in Table 5.

TABLE 5

| | element | | | | | | | | |
|---|---|---|---|---|---|---|---|---|---|
| | Zn | Al | Bi | Ga | In | Mg | Pb | Sb | Sn |
| heat treatment temperature (° C.) | 475 | 725 | 325 | 100 | 225 | 700 | 375 | 700 | 300 |

Thereafter, a binder (epoxy resin) in an amount of 40 vol % of the total volume was added to each powder mixture and mixed. Then, in the manner same as Example 1, bond magnets were prepared. The bond magnets thus obtained were inserted into gaps of cores similar to that in Example 5 to obtain samples. Next, the samples were subjected to heat treatment at 270° C. in atmospheric air, and taken out from a furnace every 30 minutes. The DC superposition characteristics and the core loss characteristics were measured.

The DC superposition characteristics were measured by an 4284A LCR meter manufactured by Hewlett-Packard under the conditions of the AC magnetic field frequency of 100 kHz and the superposed magnetic field of 0 to 200 Oe. At this time, a superposed current was applied so that the direction of the DC bias magnetic field was opposite to the orientation upon formation of the magnet. The measurement results are shown in FIGS. 22 to 31.

It is understood from FIGS. 22 to 31 that, as compared with the sample without metal coating (FIG. 22), those cores (FIGS. 23 to 31) in which the magnets manufactured by using the magnetic alloy powders coated with the above-mentioned metals are formed in the gaps are less deteriorated in superposition characteristics and exhibit stable characteristics even if the heat treatment time is increased. Presumably, this is because oxidation is suppressed by coating the surface of the magnet with the metal to thereby suppress reduction of a bias magnetic field.

Next, for each core, the core loss characteristic at 50 kHz and 0.1 T was measured at a room temperature by the use of an SY-8232 AC BH tracer manufactured by Iwatsu Electric Co., Ltd. The results are shown in Table 6.

TABLE 6

| | heat treatment time | | | | |
|---|---|---|---|---|---|
| | 0 min | 30 min | 60 min | 90 min | 120 min |
| nothing | 180 | 250 | 360 | 450 | 600 |
| Zn | 220 | 200 | 215 | 215 | 220 |
| Al | 180 | 180 | 190 | 200 | 220 |
| Bi | 225 | 230 | 230 | 230 | 240 |

TABLE 6-continued

| | heat treatment time | | | | |
|---|---|---|---|---|---|
| | 0 min | 30 min | 60 min | 90 min | 120 min |
| Ga | 170 | 180 | 230 | 230 | 260 |
| In | 175 | 200 | 220 | 230 | 280 |
| Mg | 170 | 170 | 180 | 200 | 220 |
| Pb | 230 | 220 | 230 | 240 | 260 |
| Sb | 200 | 230 | 280 | 350 | 420 |
| Sn | 205 | 210 | 230 | 230 | 235 |

In the sample without metal coating, the increase in core loss is three times after the heat treatment for 120 minutes. On the other hand, in the samples with metal coating, the increase in core loss was 20-30% in average. Thus, it has been understood that these samples exhibit very excellent characteristics.

EXAMPLE 12

A mixture of an Sm—Co magnetic alloy powder (average particle size of about 3 μm) and 3 wt % Zn+2 wt % Mg and a mixture of the same magnetic alloy powder and 3 wt % Mg+2 wt % Al were prepared and subjected to heat treatment for 2 hours in an Ar atmosphere at 600° C. Each magnetic alloy powder was subjected to metal coating. Thereafter, a binder (epoxy resin) in an amount of 10 wt % of the total weight was mixed with each powder mixture. Thereafter, in the manner similar to Example 1, bond magnets were prepared. Then, the bond magnets were inserted into gaps of cores similar to that in Example 5 to obtain samples. The samples were subjected to heat treatment at 270° C. in atmospheric air. The samples were taken out from a furnace every hour until the heat treatment time reached 4 hours in total and every 2 hours thereafter, and the flux was measured.

The flux characteristics of the magnets were measured by a TDF-5 digital flux meter manufactured by TOEI. The measurement results are shown in Table 7 with respect to the flux amount before heat treatment as 100%.

TABLE 7

| | heat treatment time | | | | | | | |
|---|---|---|---|---|---|---|---|---|
| | 0 | 1 | 2 | 3 | 4 | 6 | 8 | 10 |
| no coating | 100 | 72 | 61 | 53 | 45 | 36 | 30 | 26 |
| $Zn_3$ wt % + $Mg_2$ wt % | 100 | 98 | 97 | 97 | 96 | 95 | 94 | 94 |
| $Mg_3$ wt % + $Al_2$ wt % | 100 | 98 | 98 | 97 | 96 | 96 | 95 | 94 |

The magnet without metal coating was demagnetized by more than 70% after 10 hours. In comparison, the magnets coated with the above-mentioned metals were demagnetized by about 6% after 10-hour heat treatment. Thus, the deterioration was very small and the stable characteristics were exhibited. Presumably, this is because oxidation is suppressed by coating the surface of the magnet with the metal to thereby suppress reduction of the flux.

So far, this invention has been described in conjunction with the several examples. However, this invention is not limited to these examples. For example, in the above-mentioned Examples 5 to 12, description has been made about the case using the method same as that in Example 1, i.e., the method of manufacturing a bond magnet by filling a material in a mold. Alternatively, in the manner similar to Example 2, a viscous material may be directly applied onto a part of a core and hardened. In this case, the bond magnet is formed in tight contact with the core. Therefore, no gap is left between the bond magnet and the core so that further improvement in characteristics can be expected.

As described above, according to this invention, it is possible to provide a method of manufacturing a bond magnet which method is capable of obtaining a bond magnet high in magnetic characteristics, easy in industrial manufacture, and inexpensive and a method of manufacturing a device using the bond magnet.

INDUSTRIAL APPLICABILITY

The invention is applicable to any device using a permanent magnet.

The invention claimed is:

1. A method of manufacturing a bond magnet, wherein:

an alloy magnetic powder magnetized in advance by applying a magnetic field ranging from 5 T to 10 T is mixed with a resin at a weight ratio within a range from 70:30 to 97:3 to obtain a viscous material with 10 poises or more, the viscous material is located at a predetermined position of a magnetic device in contact therewith, and a magnetic field ranging from 30 mT to 500 mT is applied to the viscous material to magnetically orient the alloy magnetic powder included in the viscous material while the resin is hardened.

2. The method of manufacturing a bond magnet according to claim 1, wherein:

the viscous material is arranged at a predetermined position of a magnetic device in contact therewith, and the magnetic field is applied to the viscous material arranged in contact with the magnetic device to magnetically orient the alloy magnetic powder included in the viscous material while the resin is hardened, thereby forming the bond magnet at the predetermined position of the magnetic device in contact therewith.

3. A method of manufacturing a bond magnet according to claim 1, wherein:

before the alloy magnetic powder is mixed with the resin, the alloy magnetic powder is mixed with at least one metal powder selected from Zn, Al, Bi, Ga, In, Mg, Pb, Sb, and Sn or a metal powder of an alloy thereof to obtain a mixture, and the mixture is subjected to heat treatment to coat the surface of the alloy magnetic powder with a metal film.

4. The method of manufacturing a bond magnet according to claim 1, wherein as the alloy magnetic powder, a rare earth magnetic powder having a coercive force not smaller than 5 kOe, a Curie temperature not lower than 300° C., and an average particle size of 2.0 to 50 μm is used.

5. The method of manufacturing a bond magnet according to claim 1, wherein as the alloy magnetic powder, a rare earth magnetic powder having a coercive force not smaller than 10 kOe, a Curie temperature not lower than 500° C., and an average particle size of 2.5 to 50 μm is used.

6. The method of manufacturing a bond magnet according to claim 5, wherein:

as the alloy magnetic powder, a rare earth magnetic powder having a composition of $Sm(Co_{bal.}Fe_{0.15\text{-}0.25}Cu_{0.06\text{-}0.08}Zr_{0.02\text{-}0.03})_{7.0\text{-}8.5}$ is used.

7. The method of manufacturing a bond magnet according to claim 1, wherein:

as the resin, one of a polyimide resin, an epoxy resin, a polyphenylene sulfide resin, a silicone resin, a polyester resin, an aromatic nylon, or a liquid-crystal polymer is used.

8. A method of manufacturing a magnetic device including a bond magnet, wherein:

the bond magnet is formed by:

applying a magnetic field ranging from 5 T to 10 T to an alloy magnetic powder to magnetize the alloy magnetic powder;

mixing the magnetized alloy magnetic powder and a resin at a weight ratio within a range from 70:30 to 97:3 to obtain a viscous material with a viscosity of 10 poises or more;

arranging the viscous material at a predetermined position of the magnetic device in contact therewith; and applying a magnetic field ranging from 30 mT to 500 mT to the viscous material to magnetically orient the alloy magnetic powder included in the viscous material while the resin is hardened, thereby forming the bond magnet at the predetermined position in contact therewith.

9. The method of manufacturing a magnetic device including a bond magnet according to claim 8, wherein:

the predetermined position is a pair of surfaces opposite to each other and defining a magnetic gap, and the viscous material is arranged in the magnetic gap to bring the viscous material into contact with both of the surfaces.

10. The method of manufacturing a magnetic device including a bond magnet according to claim 8, wherein:

the predetermined position is an end surface of a drum-type core or an outer peripheral surface of a flange portion, and the viscous material is applied in a ring shape on the end surface or the outer peripheral surface of the flange portion.

11. A method of manufacturing a bond magnet according to claim 2, wherein:

before the alloy magnetic powder is mixed with the resin, the alloy magnetic powder is mixed with at least one metal powder selected from Zn, Al, Bi, Ga, In, Mg, Pb, Sb, and Sn or a metal powder of an alloy thereof to obtain a mixture, and the mixture is subjected to heat treatment to coat the surface of the alloy magnetic powder with a metal film; and as the resin, one of a polyimide resin, an epoxy resin, a polyphenylene sulfide resin, a silicone resin, a polyester resin, an aromatic nylon, or a liquid-crystal polymer is used.

12. The method of manufacturing a bond magnet according to claim 2, wherein as the alloy magnetic powder, a rare earth magnetic powder having a coercive force not smaller than 5 kOe, a Curie temperature not lower than 300° C., and an average particle size of 2.0 to 50 μm is used.

13. The method of manufacturing a bond magnet according to claim 3, wherein as the alloy magnetic powder, a rare earth magnetic powder having a coercive force not smaller than 5 kOe, a Curie temperature not lower than 300° C., and an average particle size of 2.0 to 50 μm is used.

14. The method of manufacturing a bond magnet according to claim 2, wherein as the alloy magnetic powder, a rare earth magnetic powder having a coercive force not smaller than 10 kOe, a Curie temperature not lower than 500° C., and an average particle size of 2.5 to 50 μm is used.

15. The method of manufacturing a bond magnet according to claim 3, wherein as the alloy magnetic powder, a rare earth magnetic powder having a coercive force not smaller than 10 kOe, a Curie temperature not lower than 500° C., and an average particle size of 2.5 to 50 μm is used.

* * * * *